US006177760B1

(12) United States Patent
Okawa et al.

(10) Patent No.: US 6,177,760 B1
(45) Date of Patent: Jan. 23, 2001

(54) DEFLECTION YOKE WITH A COMPENSATION COIL HAVING DAMPING MATERIAL COMPOSED OF A SILICON COMPOSITION

(75) Inventors: Yusuke Okawa; Yoji Motomiya, both of Iwai; Takasuke Koga; Naoki Hatakeyama, both of Ibaraki-ken; Keiji Morimoto, Toride; Kinji Fukui, Sanwa-machi; Kenichi Ikeda, Chiba, all of (JP)

(73) Assignee: Victor Company of Japan, Ltd., Yokohama (JP)

( * ) Notice: Under 35 U.S.C. 154(b), the term of this patent shall be extended for 0 days.

(21) Appl. No.: 09/082,824

(22) Filed: May 21, 1998

(30) Foreign Application Priority Data

May 23, 1997 (JP) ..... 9-150178
Dec. 26, 1997 (JP) ..... 9-369394
Jan. 20, 1998 (JP) ..... 10-022641

(51) Int. Cl.[7] ..... H01J 29/70

(52) U.S. Cl. ..... 313/440; 313/442; 335/212; 335/213

(58) Field of Search ..... 313/440, 442; 335/210, 212, 213, 214; 525/478; 445/45

(56) References Cited

U.S. PATENT DOCUMENTS 4,551,765 * 11/1985 Meeder, Jr. ..... 358/248
5,268,433 * 12/1993 Ikeno et al. ..... 525/478

FOREIGN PATENT DOCUMENTS 7-220659 8/1995 (JP) .

* cited by examiner

*Primary Examiner*—Michael H. Day
*Assistant Examiner*—Karabi Guharay
(74) *Attorney, Agent, or Firm*—Anderson, Kill & Olick P.C.

(57) ABSTRACT

The present invention provides deflection yoke devices used for a cathode ray tube. One of the deflection yoke devices of the present invention comprises a compensation coil having a bobbin formed with a hollow in which an internal thread is cut, a screw core forcibly fitting in the hollow of the bobbin and a damping material interposed between the bobbin and the screw core to prevent the displacement of the screw core when an external vibration or a shock is applied to the deflection yoke device. Another of the deflection yoke devices comprises a compensation coil having a bobbin formed with a cylindrical hollow in which an internal thread is cut, and a screw core fitting in the internal thread of the cylindrical hollow to allow the screw core to be displaced in a longitudinal direction of the cylindrical hollow, wherein the bobbin comprises first and second halves which are made by dividing the bobbin into two parts along a longitudinal direction of the bobbin, and a retainer section is provided on one of the first and second halves so as to extend to another of the first and second halves to allow the screw core to be pressed so that the displacement of the screw core due to vibration or shock is prevented.

5 Claims, 26 Drawing Sheets

DEFLECTION YOKE WITH A COMPENSATION COIL HAVING DAMPING MATERIAL COMPOSED OF A SILICON COMPOSITION

BACKGROUND OF THE INVENTION

1. Field of the Invention

The present invention relates to a deflection yoke device provided with a compensation coil which comprises a cylindrical bobbin, coils wound around the bobbin and a magnetic core installed in the bobbin, wherein a misconvergence is compensated by displacing the core to an optimum position in the bobbin.

2. Description of the Related Art

FIG. 1 is a perspective and partially cutaway view a deflection yoke device in the prior art;

FIG. 2 is a perspective view showing a compensation coil shown in FIG. 1;

FIG. 3 is a sectional view showing the compensation coil shown in FIG. 2.

In FIG. 1, a pair of horizontal deflection yoke coils 3*a*, 3*b* and a pair of vertical deflection yoke coils 2, each wound in a saddle shape, are respectively provided on inner and outer surfaces of a separator 1 having a cone shape for supporting these vertical and horizontal deflection yoke coils 3*a*, 3*b* and 2 and for electrically insulating the vertical and horizontal deflection yoke coils 3*a*, 3*b* and 2 from each other. Further, an outside of the vertical deflection coils 2 is covered by a core 4 having a cone shape and made of a magnetic material such as ferrite.

In the deflection yoke device, it is needed a circuit for compensating a deflection characteristic. A printed circuit board 5 for mounting such a circuit and electric parts is provided on a side portion of the separator 1, for instance, being extended from a first flange section 1*a* having a large diameter to a second flange section 1*b* having a smaller diameter.

On the printed circuit board 5, there are defined a plurality of approximately rectangular holes 5*a*. The printed circuit board 5 is fixed on a side section of the separator 1 by causing an end thereof to engage with an engage section 1*a*1 integrally formed on the first flange section 1*a* and causing the rectangular holes 5*a* to engage with nails 1*b*1 integrally formed on the second flange section 1*b*.

On the printed circuit board 5, there is also mounted a compensation coil 7 for compensating a misconvergence as explained hereinafter. Specifically, the compensation coil 7 is fixed on the printed circuit board 5 by causing nails 7*a* formed at distal ends thereof in a longitudinal direction to be engaged with the rectangular holes 5*a*, 5*a* of the printed circuit board 5.

Further, on the second flange section 1*b*, there is provided a compensation coil 6 having four poles for compensating a coma error, so-called VCR. Here, a reference character 9 denotes a connector for connecting the deflection yoke device to a power source (not shown).

Furthermore, on the printed circuit board 5, there are erected plural terminals 8 for connecting leads 2' of the vertical deflection coil 2, leads 3*a*', 3*b*' of the horizontal deflection coils 3*a*, 3*b*, and lead 6' of the compensation coil 6, and lead 9' of the connector 9 by soldering (not shown).

Here, a description is given of a construction and an operation of the compensation coil 7.

As shown in FIG. 2, the compensation coil 7 comprises a bobbin 10, coils 11, 12 and a core 13. On the bobbin 10 made of an insulative material, there are wound a first coil 11 between the flanges 10*b*, 10*c* to be electrically connected to the horizontal deflection coil 3*a* and a second coil 12 between the flanges 10*d*, 10*e* to be electrically connected to the horizontal deflection coil 3*b*.

In the bobbin 10, there is defined a cave 10*a* having an approximately cylindrical shape in a longitudinal direction of the bobbin 10. In the cave 10*a*, there is fitted a core (referred to as a screwed core hereinafter) 13 having an external thread on an outer surface thereof.

As shown in FIG. 3, plural projection ribs 15 are integrally formed on the inner surface of the cave 10*a* of the bobbin 10 being extended in the longitudinal direction of the bobbin, and the screwed core 13 is forcibly engaged with the ribs 15 of the cave 10*a* in the bobbin 10.

Further, the screwed core 13 is defined with a hexagonal hole 13*a* penetrating in the longitudinal direction of the bobbin 10.

FIG. 4 is a sectional view of the compensation coil for explaining an installment operation of a screw core to a bobbin of the compensation coil manually;

FIG. 5 is a sectional view of compensation coil for explaining the installment operation of the screw core to the bobbin of the compensation coil automatically;

FIG. 6 is a sectional view of the compensation coil for explaining the installment operation of the screw core to the bobbin of the compensation coil;

FIG. 7 is a circuit for connecting the horizontal deflection coils 3*a*, 3*b* and the compensation coils 7, 70, 71, 72 and FIG. 8 is a misconvergence pattern which is compensated by the compensation coils.

In FIG. 4, a reference character 14 designates a jig for rotating the screwed core 13. The distal end of the jig 14 is made to be hexagonal to allow the distal end to be inserted into the hexagonal hole 13*a* of the screwed core 13. When the screwed core 13 is manually screwed into the cave 10*a* from, for instance, the left side of the bobbin 10 with the jig 14, the screwed core 13 is installed in the bobbin 10, cutting a thread on the projection rib 15. For simplicity, the thread is not depicted in FIG. 4.

In FIG. 4, the screw core 13 is manually installed in the bobbin 10. However, in the mass production the screwed core 13 is automatically inserted into the bobbin 10 by an automatic machine.

In FIGS. 5 and 6, a reference character 16 denotes an automatic machine for inserting the screwed core 13 into the cave 10*a* by rotating the screw core 13. The distal end 16*a* of the automatic machine 16 has a hexagonal shape to allow the distal end to be inserted into the hexagonal hole 13*a* of the screw core 13.

As shown in FIG. 5, first, the screwed core 13 is screwed into the cave 10*a* from one end of the bobbin 10. Then, the screwed core 13 is transferred being screwed in until another end of the bobbin 10. Thereby, an internal thread is cut on the projection rib 15 in a longitudinal direction of the bobbin 10.

Next, the screwed core 13 is rotated in a reverse direction so that the screwed core 13 is approximately positioned at a center of the bobbin 10 in the longitudinal direction as shown in FIGS. 2 and 4.

The compensation coil 7 constructed as mentioned above is installed on the deflection yoke device as explained referring to FIG. 1, and is electrically connected to the horizontal deflection coils 3*a*, 3*b* as shown in FIG. 7.

Specifically, the horizontal deflection coils 3*a*, 3*b* are connected in parallel to each other and between a plus terminal (+) and a minus terminal (−), and coils 11, 12 of the compensation coil 7 are connected in series to each other and between the horizontal deflection coils 3*a*, 3*b* as shown in FIG. 7. Upon operation, the currents I*a*, I*b* flow through the horizontal deflection coils 3*a*, 3*b*, respectively.

Upon a delivery inspection, the abovementioned deflection yoke device is mounted on an inspection CRT to allow the adjustment of the deflection characteristics as mentioned hereinafter. Further, the inspection CRT refers to a CRT designated by a maker, so-called ITC (Integrated Tube Component) maker which sells such a deflection yoke device combined with a CRT characteristically matched to the deflection yoke.

Before delivering the deflection yoke device to the ITC maker, the deflection yoke device is mounted on the inspection CRT as shown in FIG. 1, and a worker differentially changes the inductances L11 and L12 of the coils 11 and 12 by rotating and transferring the screw core 13 in a B-B' direction as shown in FIG. 4 and 17.

Thereby, the currents I*a* and I*b* flowing through the horizontal deflection coils 3*a*, 3*b* are adjusted, and a magnetic field generated by the horizontal deflection coils 3*a*, 3*b* is controlled. As a result, a displacement amount Xv of a red line from a blue line, which is one of the misconvergences shown in FIG. 8, is compensated.

In the ITC maker, the delivered deflection yoke devices are installed on mass-produced CRTs. There may be a slight difference in electric characteristics between the inspection CRT and the mass-produced CRTs. Thus, the ITC maker adjusts again the position of the screw core 13 of the deflection yoke device mounted on the CRT (hereinafter referred to as an ITC state) to eliminates the misconvergence generated on a display of the CRT by rotating the screw core 13 with the jig 14 as shown in FIG. 4.

Then, adjusted CRTs in the ITC state are delivered to, for instance, computer display instrument makers.

When the deflection yoke devices are transported to the ITC maker by vehicles, vibration may be applied to the deflection yoke devices, thus to the compensation coils 7 for a long time. The vibration causes a problem that the screw core 13 is displaced in the cave 10*a* in the B-B' direction as shown in FIGS. 4 and 7.

When the position of the screw core 13 is displaced, the adjusted deflection characteristic of the deflection yoke device is largely changed, which causes a problem of re-adjustment, resulting in a loss time. In the worst case, the screw core 13 is slipped off from the bobbin 10.

Further, when the deflection yoke devices are transported to display instrument makers, the same vibration is applied to the deflection yoke devices, resulting in the same problem mentioned above.

In order to solve the problems, there is proposed a method in Japanese Patent laid-open Publication 7-220659, wherein the screw core 13 is fixed by using an adhesive after the adjustment of the deflection characteristic of the deflection yoke device. However, as the screw core 13 is tightly fixed by applying the adhesive, it is necessary to apply the adhesive to the screw core 13 at the latest adjustment stage in the manufacturing process.

Further, applying the adhesive to the screw core means an extra production process. This causes a problem of decreasing a working efficiency.

In addition, there are other problems as follows.

As mentioned in the foregoing, in the deflection coils 7 in the prior art, the screw core 13 is screwed into the cave 10*a* of the bobbin 10. Thereby, the internal thread is cut on the projection ribs 15. Thus, the shape of the internal thread cut on the projection ribs 15 does not maintain a constant shape due to a dispersion of a dimension (height) of the projection rim 15 caused by the dispersion of the resin mold conditions and a dispersion of an outer diameter of the screw core 13. As a result, the rotational torque for rotating the screw core 13 becomes erratic.

Accordingly, as explained referring to FIGS. 5 and 6, upon cutting the internal thread on the projection ribs 15 by the automatic machine 16, it is necessary to adjust an optimum rotational number for rotating the screw core 13 and an optimum reciprocal movement number for reciprocating the screw core 13 in the cave b1a every time when the internal thread is cut on the projection ribs 15 of the bobbin 10 because the optimum numbers of core rotation and of repetition of movement of the screw core 13 are obliged to change for every bobbin 10. The dispersion of required torque of the screw core 13 makes it difficult to further adjust the position of the screw core 13 in the alignment process.

Further, when a height of the projection ribs 15 becomes too high or the outer diameter of the screw core 13 becomes too large, not only the rotational torque becomes large but also chipping and crack are apt to be developed on the screw core 13. When the screw core 13 is repeatedly rotated, the projection ribs 15 are broken to reduce the rotational torque for rotating the screw core 13. This causes a problem that the screw core 13 can no longer be held at a desired position.

SUMMARY OF THE INVENTION

Accordingly, a general object of the present invention is to provide a deflection yoke device, in which the above disadvantages have been eliminated.

A specific object of the present invention is to provide a deflection yoke device used for a cathode ray tube comprising: a compensation coil having a bobbin formed with a cave in which an internal thread is cut; a screw core forcibly fitting in the cave of the bobbin to allow the screw core to be displaced in a longitudinal direction of the bobbin; and a damping material interposed between the bobbin and the screw core to prevent a displacement of the screw core when an external disturbance such as a vibration or a shock is applied to the deflection yoke device.

An another and more specific object of the present invention is to provide a deflection yoke device used for a cathode ray tube comprising: a compensation coil having a bobbin formed with a cave in which an internal thread is cut; a screw core fitting in the cave of the bobbin to allow the screw core to be displaced in a longitudinal direction of the bobbin; and a gel material interposed between the bobbin and the screw core to prevent a displacement of the screw core when an external vibration or a shock is applied to the deflection yoke device.

Other specific object of the present invention is to provide a deflection yoke device used for a cathode ray tube comprising: a compensation coil having a bobbin formed with a cave in which an internal thread is cut; a screw core fitting in the cave of the bobbin to allow the screw core to be displaced in a longitudinal direction of the bobbin; and a liquid material interposed between the bobbin and the screw core to prevent a displacement of the screw core when an external vibration or a shock is applied to the deflection yoke device.

Other specific object of the present invention is to provide a deflection yoke device used for a cathode ray tube comprising: a compensation coil having a bobbin formed with a cave in which an internal thread is cut; a screw core fitting in the cave of the bobbin; and a solid material interposed between the bobbin and the screw core to prevent the screw core from being displaced when an external vibration or a shock is applied to the compensation coil.

Other specific object of the present invention is to provide a deflection yoke device used for a cathode ray tube comprising: a compensation coil having a bobbin formed with a cylindrical cave in which an internal thread is cut; a screw core fitting the thread of the cylindrical cave to allow the screw core to be displaced in a longitudinal direction of the cylindrical cave; and a retainer section provided on the bobbin to press the screw core for holding the screw core when an external vibration or a shock is applied to the deflection yoke device.

Other specific object of the present invention is to provide a deflection yoke device used for a cathode ray tube comprising: a compensation coil having a bobbin formed with a cylindrical cave in which an internal thread is cut; and a screw core fitting in the internal thread of the cylindrical cave to allow the screw core to be displaced in a longitudinal direction of the cylindrical cave; wherein the bobbin comprises first and second halves which are formed by dividing the bobbin into two parts along a longitudinal direction of the bobbin, and a retainer section provided on one of the first and second halves so as to extend to another of the first and second halves to allow the screw core to be pressed and to be prevented from displacing in the bobbin when an external vibration or a shock is applied to the deflection yoke device.

Other objects and further features of the present invention will be apparent from the following detailed description.

DETAILED DESCRIPTION OF THE PREFERRED EMBODIMENTS

Next, the description is given of the embodiments of the deflection yoke devices in the present invention referring to drawings.

[First embodiment]

Figure 9:
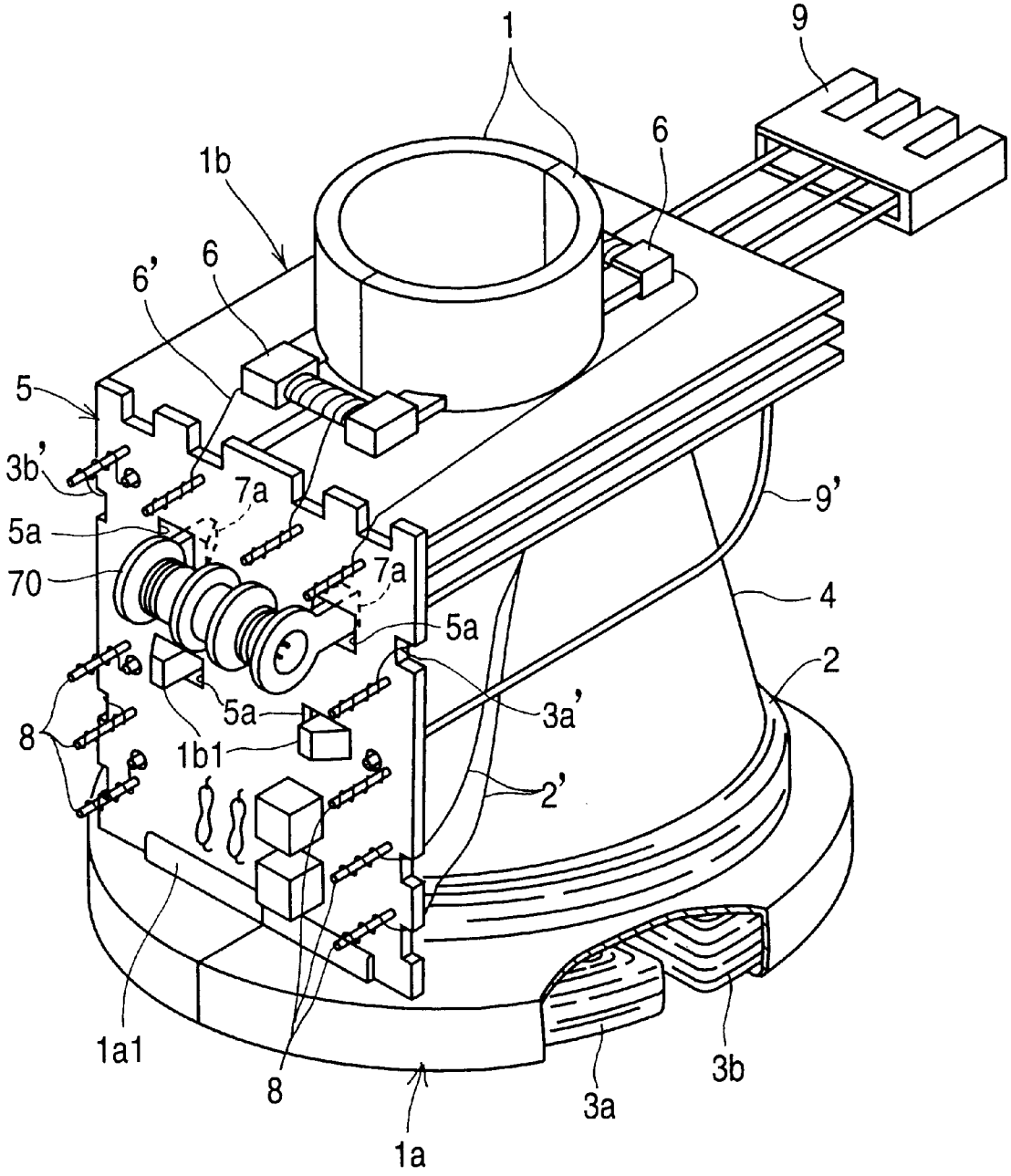
FIG. 9 is a partially cutaway and perspective view showing a deflection yoke device of a first embodiment in the present invention.
Figure 10:
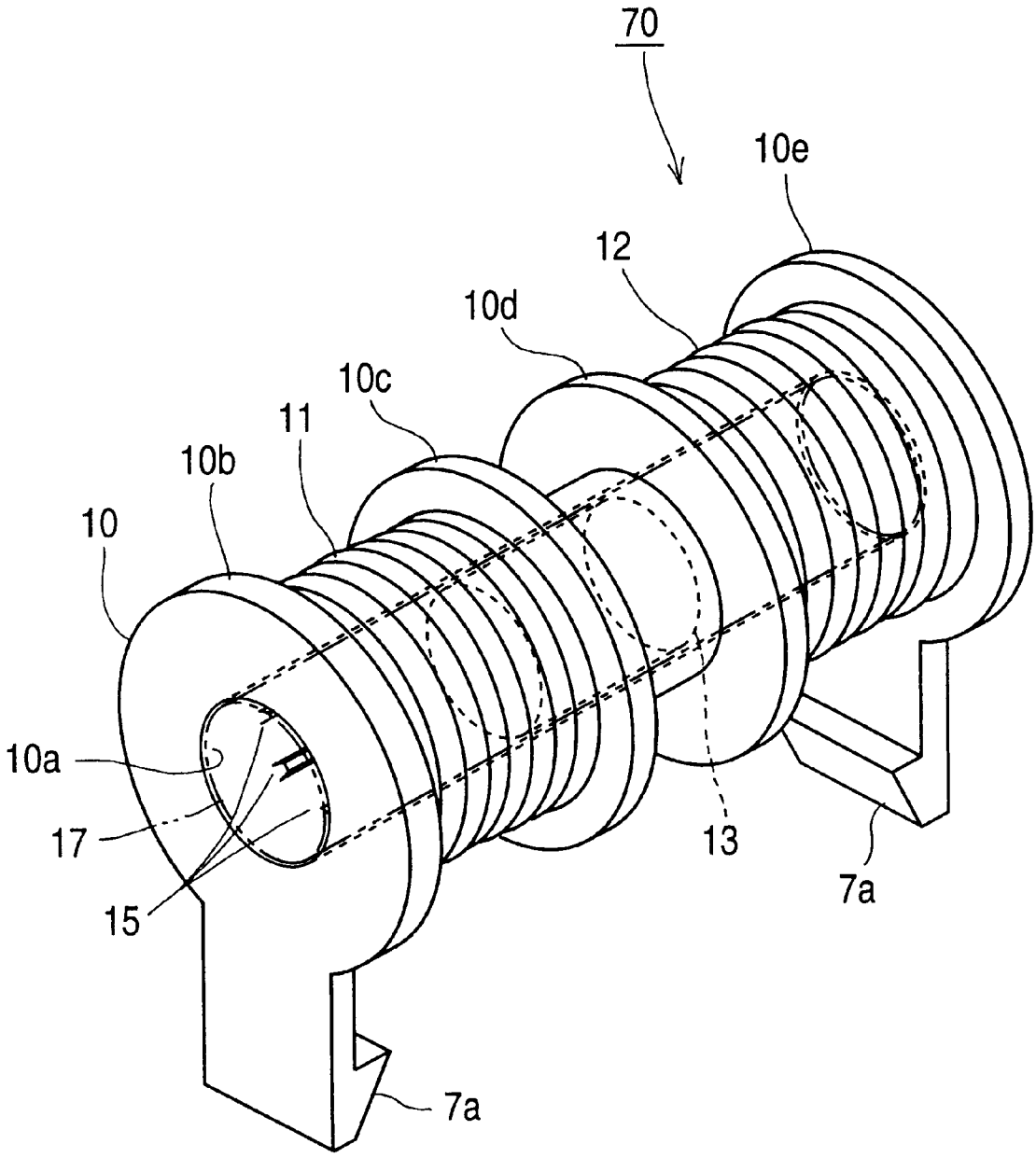
FIG. 10 is a perspective view showing a compensation coil shown in FIG. 9, which is a main part of the deflection yoke device of the first embodiment in the present invention.
Figure 11:
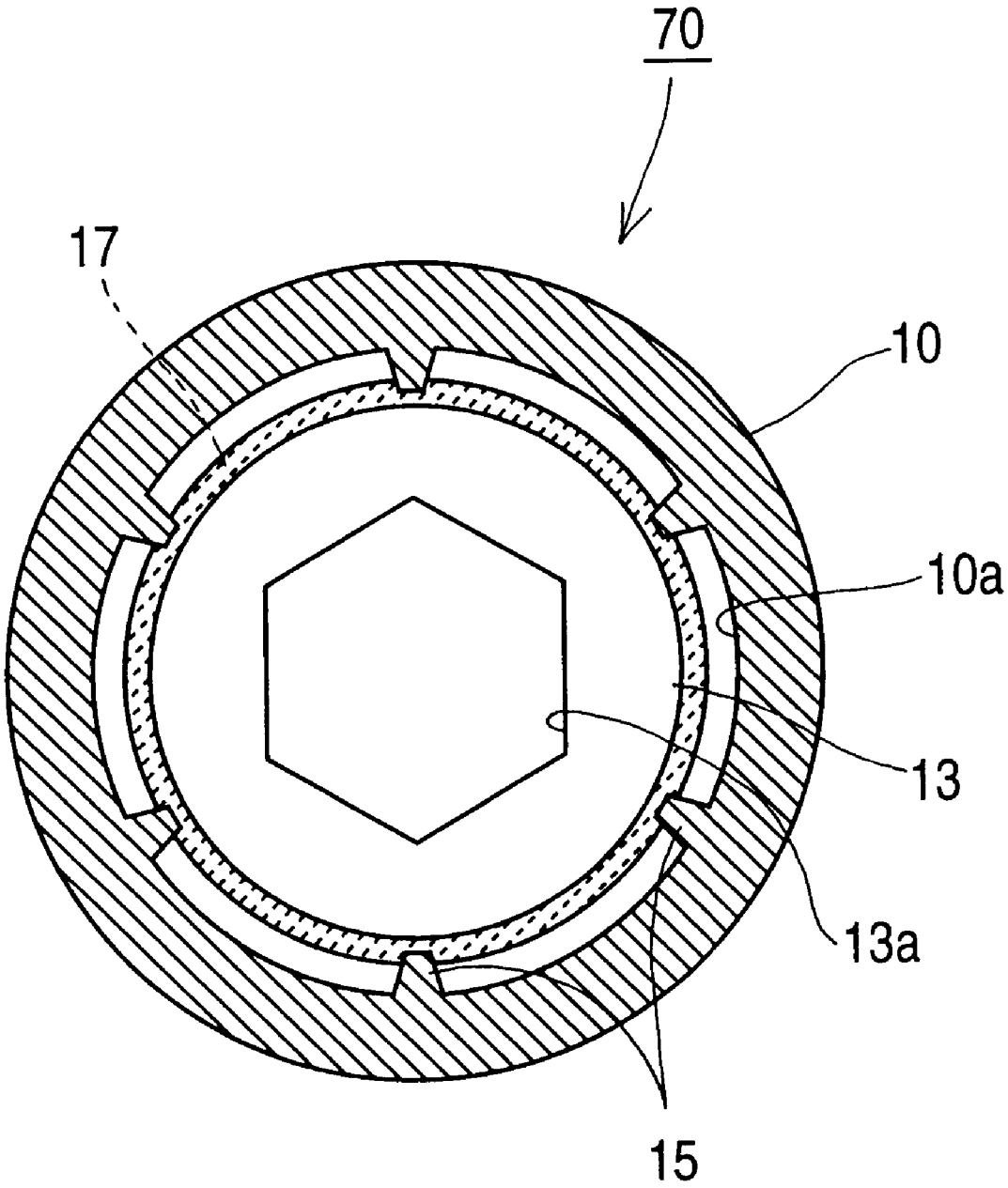
FIG. 11 is a sectional view of the compensation coil shown in FIG. 10.
Figure 12:
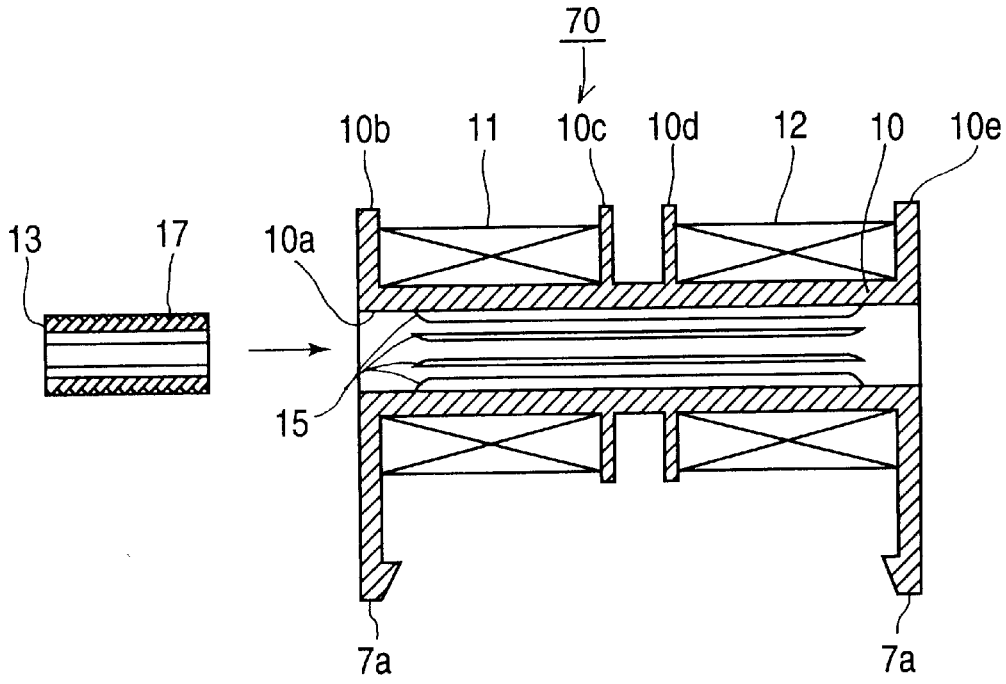
FIGS. 12 and 13 are sectional views of the first embodiment in the present invention for explaining an operation of the compensation coil.
Figure 13:
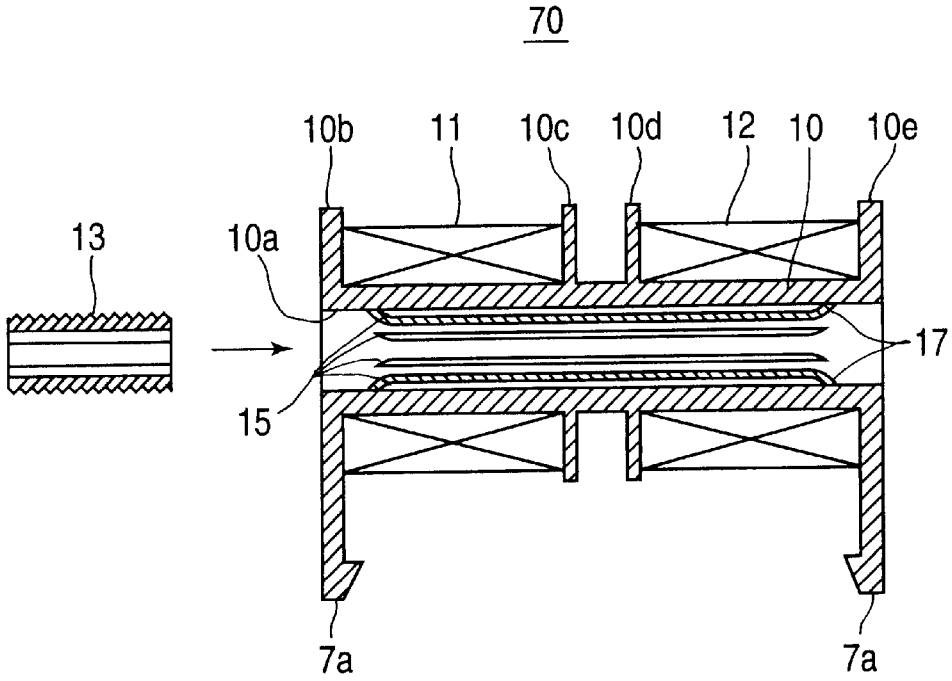
Figure 14:
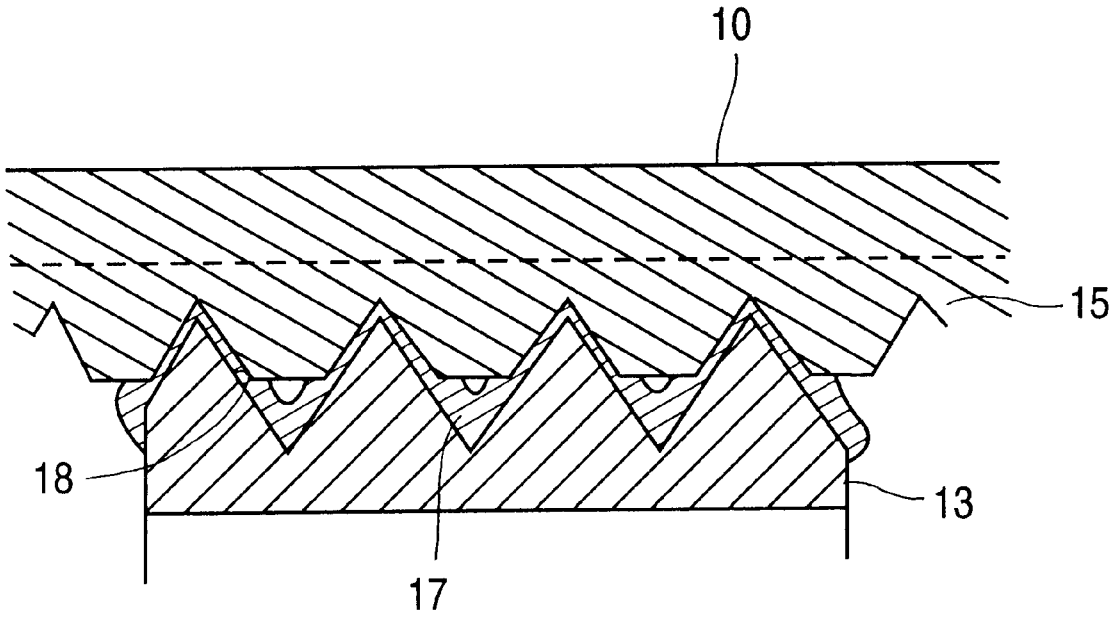
FIG. 14 is a partially enlarged sectional view for explaining the operation of the first embodiment of the present invention.
Figure 15A:
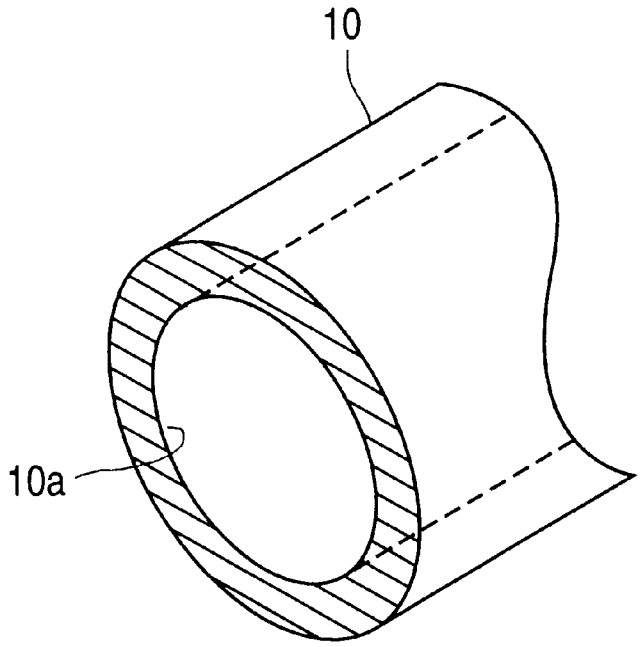
FIGS. 15 (A) and (B) are perspective views showing modification of the deflection yoke device of the first embodiment.

FIG. 9 is a partially cutaway and perspective view showing a deflection yoke device of a first embodiment in the present invention;

FIG. 10 is a perspective view showing the compensation coil shown in FIG. 9, which is a main part of the deflection yoke device of the first embodiment in the present invention;

FIG. 11 is a sectional view of the compensation coil shown in FIG. 10;

FIGS. 12 and 13 are sectional views of the compensation coil for explaining an operation of the first embodiment in the present invention;

FIG. 14 is a partially enlarged sectional view of a part of the compensation coil for explaining the operation of the first embodiment of the present invention; and FIGS. 15 (A) and (B) are perspective views showing modifications of the deflection yoke device of the first embodiment.

In FIGS. 9 to 15, the same components as those shown in FIG. 1 to 8 are designated with the same reference characters.

First, the description is given of an overall construction of a deflection yoke device of the first embodiment of the present invention.

In FIG. 9, a pair of horizontal deflection yoke coils 3*a*, 3*b* and a pair of vertical deflection yoke coils 2, each wound in a saddle shape, are respectively provided on inner and outer surfaces of a separator 1 having a cone shape for supporting these vertical and horizontal deflection yoke coils 3*a*, 3*b*, and 2 and for electrically insulating them from each other. Further, a core 4 made of a magnetic material such as ferrite covers an outside of the vertical deflection coils 2.

In the deflection yoke device, it is needed a circuit for compensating a deflection characteristic. A printed circuit board 5 for mounting such a circuit and electric parts is provided on a side portion of the separator 1, for instance, being extended from a first flange section 1*a* having a large diameter to a second flange section 1*b* having a smaller diameter.

On the printed circuit board 5, there are defined a plurality of approximately rectangular holes 5*a*. The printed circuit board 5 is fixed on the side section of the separator 1 by causing an end portion thereof to engage with an engage section 1*a*1 integrally formed on the first flange section 1*a* and causing the rectangular holes 5*a* to engage with nails 1*b*1 integrally formed on the second flange section 1*b*.

On the printed circuit board 5, there is also mounted a compensation coil 70 for compensating a misconvergence as explained. Specifically, the compensation coil 70 is fixed on the printed circuit board 5 by causing nails 7*a* formed at distal ends thereof in a longitudinal direction to engage with the rectangular holes 5*a*, 5*a* of the printed circuit board 5.

Further, on the second flange section 1*b*, there is provided a four pole compensation coil 6 having four poles for compensating a coma error, so-called VCR. Here, a reference character 9 denotes a connector for connecting the deflection yoke device to the driving source.

Furthermore, on the printed circuit board 5, there are erected plural terminals 8 around which leads 2' of the vertical deflection coil 2, leads 3*a*', 3*a*' of the horizontal deflection coils 3*a*, 3*b*, and lead 6' of the compensation coil 6, and lead 9' of the connector 9 are respectively connected and soldered (not shown).

Here, a description is given of a construction and an operation of the compensation coil 70 of the first embodiment of the present invention.

As shown in FIG. 10, the compensation coil 70 comprises a bobbin 10, coils 11, 12, a core 13 and a damping material (lubricant) 17 provided between the bobbin 10 and a core (referred to as screw core) 13. On the bobbin 10 made of an insulative material, there are wound a first coil 11 between the flanges 10*b* and 10*c* to be electrically connected to the horizontal deflection coil 3*a* and a second coil 12 between the flanges 10*d* and 10*e* to be electrically connected to the horizontal deflection coil 3*b*.

In the bobbin 10, there is defined a hollow b1a having an approximately cylindrical shape in a longitudinal direction of the bobbin 10. In the hollow 10*a*, there is fitted the screw core 13 having an external thread on an outer surface thereof.

As shown in FIG. 11, plural projection ribs 15 are integrally formed on the inner surface of the hollow b1a of the bobbin 10 being extended in the longitudinal direction of the bobbin 10, and the screwed core 13 is forcibly fitted in the hollow 10*a* by depressing the projection ribs 15 of the hollow 10*a* in the bobbin 10.

Further, the screwed core 13 is defined with a hexagonal hole 13*a* penetrating in a longitudinal direction of the screw core 13.

Figure 5:
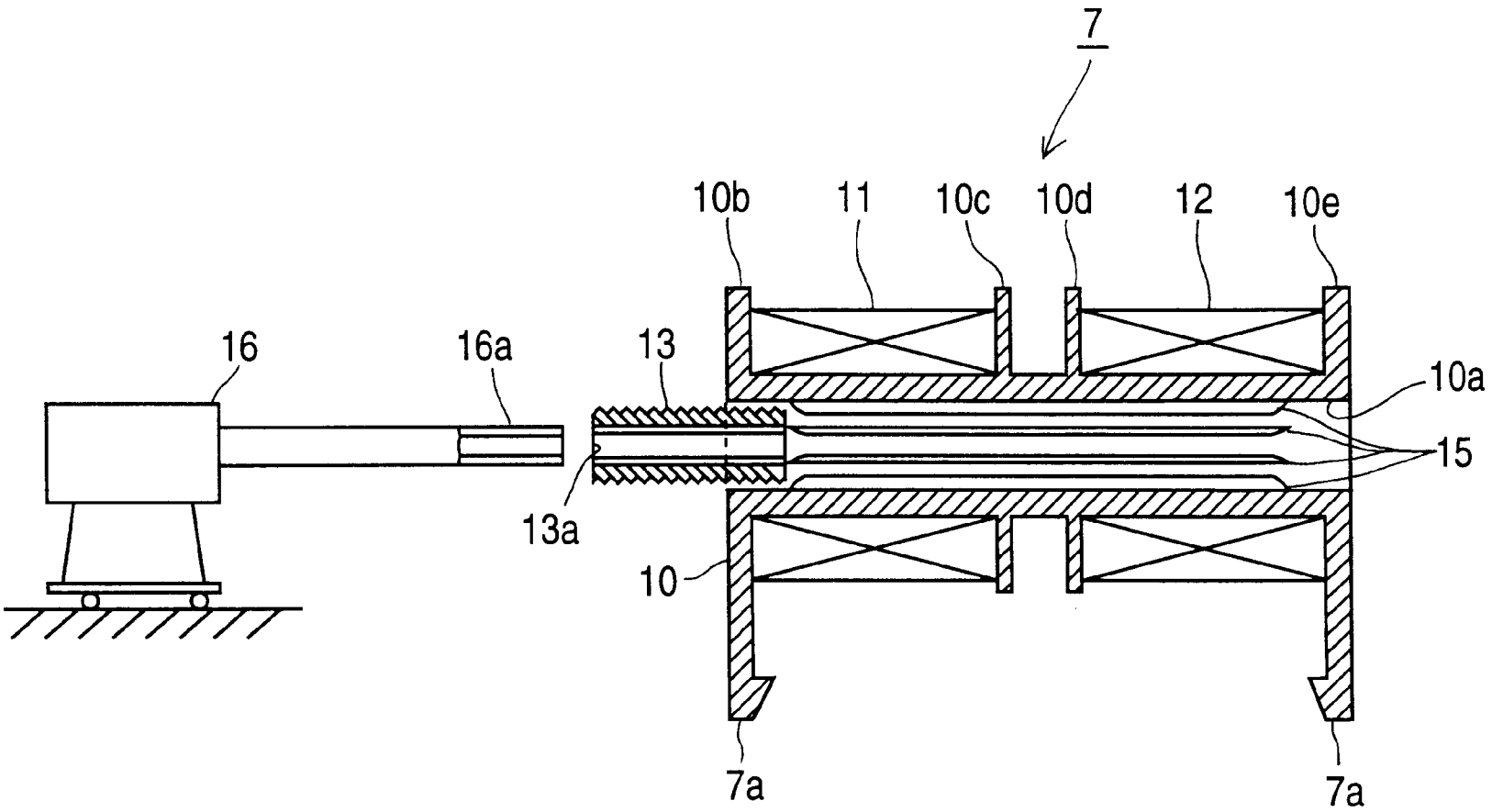
Fig. 5 PRIOR ART
FIG. 5 is a sectional view of the compensation coil for explaining the installment operation of the screw core to the bobbin of the compensation coil automatically.

When the screwed core 13 is screwed into the hollow 10*a*, the screwed core 13 is automatically inserted into the bobbin 10 from one end thereof by the automatic machine 16 shown in FIG. 5 as mentioned in the prior art.

Figure 6:
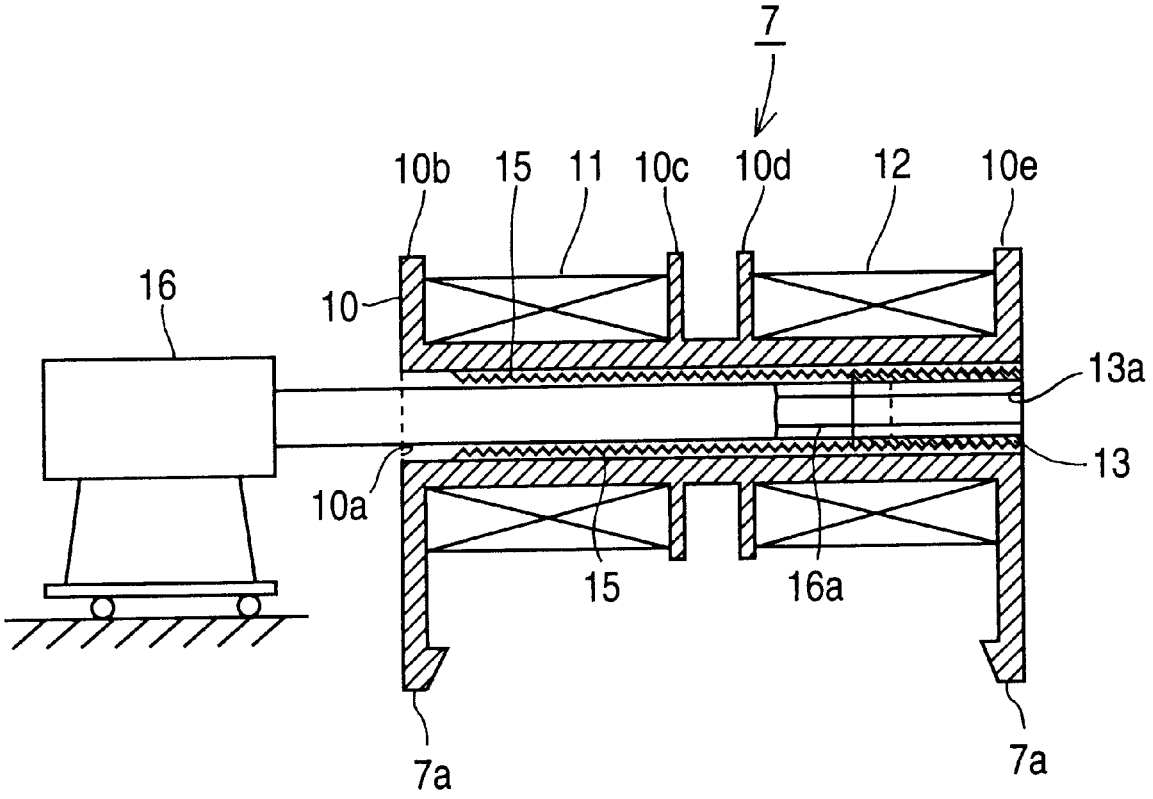
Fig. 6 PRIOR ART
FIG. 6 is a sectional view one step of the compensation coil for explaining the installment operation of the screw core to the bobbin of the compensation coil automatically.

As shown in FIG. 5, first, the screwed core 13 is screwed into the hollow 10*a* from one end of the bobbin 10. Then, the screwed core 13 is forwarded until another end of the bobbin 10 as shown in FIG. 6. Thereby, a thread is formed over the projection rib 15 in a longitudinal direction of the bobbin 10. Next, the screwed core 13 is rotated in a reverse direction so that the screwed core 13 is approximately positioned at a center of the bobbin 10 in the longitudinal direction as shown in FIG. 10.

Figure 7:
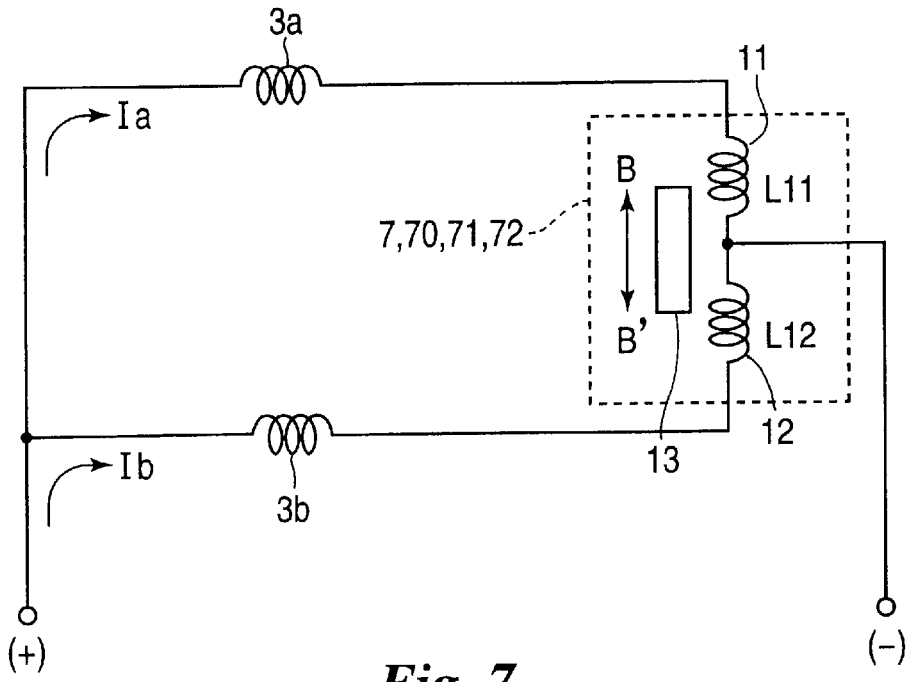
FIG. 7 is a circuit for connecting the horizontal deflection coils 3*a*, 3*b* and the compensation coils 7, 70, 71 and 72.

The compensation coil 70 constructed as mentioned above is installed on the deflection yoke device as explained referring to FIG. 9, and is electrically connected to the horizontal deflection coils 3*a*, 3*b* as shown in FIG. 7.

Specifically, the horizontal deflection coils 3*a*, 3*b* are connected in parallel to each other and between a plus terminal (+) and a minus terminal (−), and coils 11, 12 of the compensation coil 70 are connected in series to each other between the horizontal deflection coils 3*a*, 3*b* as shown in FIG. 7. Upon the operation of the deflection yoke device, the currents I*a*, I*b* flow through the horizontal deflection coils 3*a*, 3*b*, respectively.

Figure 8:
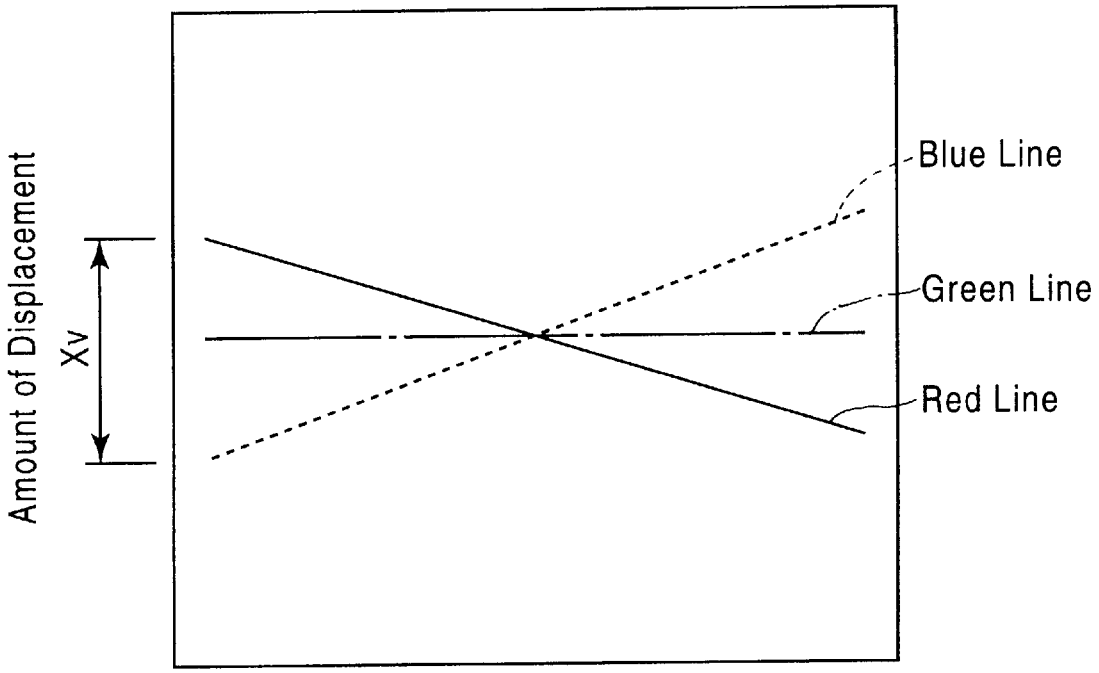
FIG. 8 is a misconvergence pattern on a CRT display, which pattern is compensated by the compensation coils.

When the screw core 13 is displaced in the longitudinal direction of the hollow 10*a* by rotating, the inductances of the coils 11, 12 are differentially changed. Thereby, the currents I*a*, I*b* flowing through the horizontal deflection coils 3*a*, 3*b* are adjusted and an intensity of a magnetic field developed by the horizontal deflection coils 3*a*, 3*b* are controlled. As a result, a displacement amount Xv of the red and blue lines, which is one of misconvergences shown in FIG. 8, is compensated.

As mentioned in the foregoing, there is the damping material 17 interposed between the bobbin 10 forming a part of the compensation coil 70 and the screw core 13. The damping material 17 is made of a liquid or a gel material or the like. It is desirable for the damping material 17 to have a moderate viscosity. As an example of the damping material 17, it is possible to use a silicone oil of SH200CV (TOYO RAYON/DOW-CORNING SILICONE INC.)

The present inventors discovered a fact that the damping material 17 interposed between the bobbin 10 and the screw core 13 perfectly prevents the displacement of the screw core 13 in the hollow 10*a* of the bobbin 10 caused by the vibration when transported.

The viscosity of the damping material 17 is preferably to be 0.5 to $10\times10^5$ [cSt], taking account of an easiness of applying it between the bobbin 10 and the screw core 13, wherein the [cSt] designates Stoks centimeter.

It is desirable to employ the silicone oil SH200CV in view of that it does not erode the bobbin 10 made of a plastic.

Figure 1:
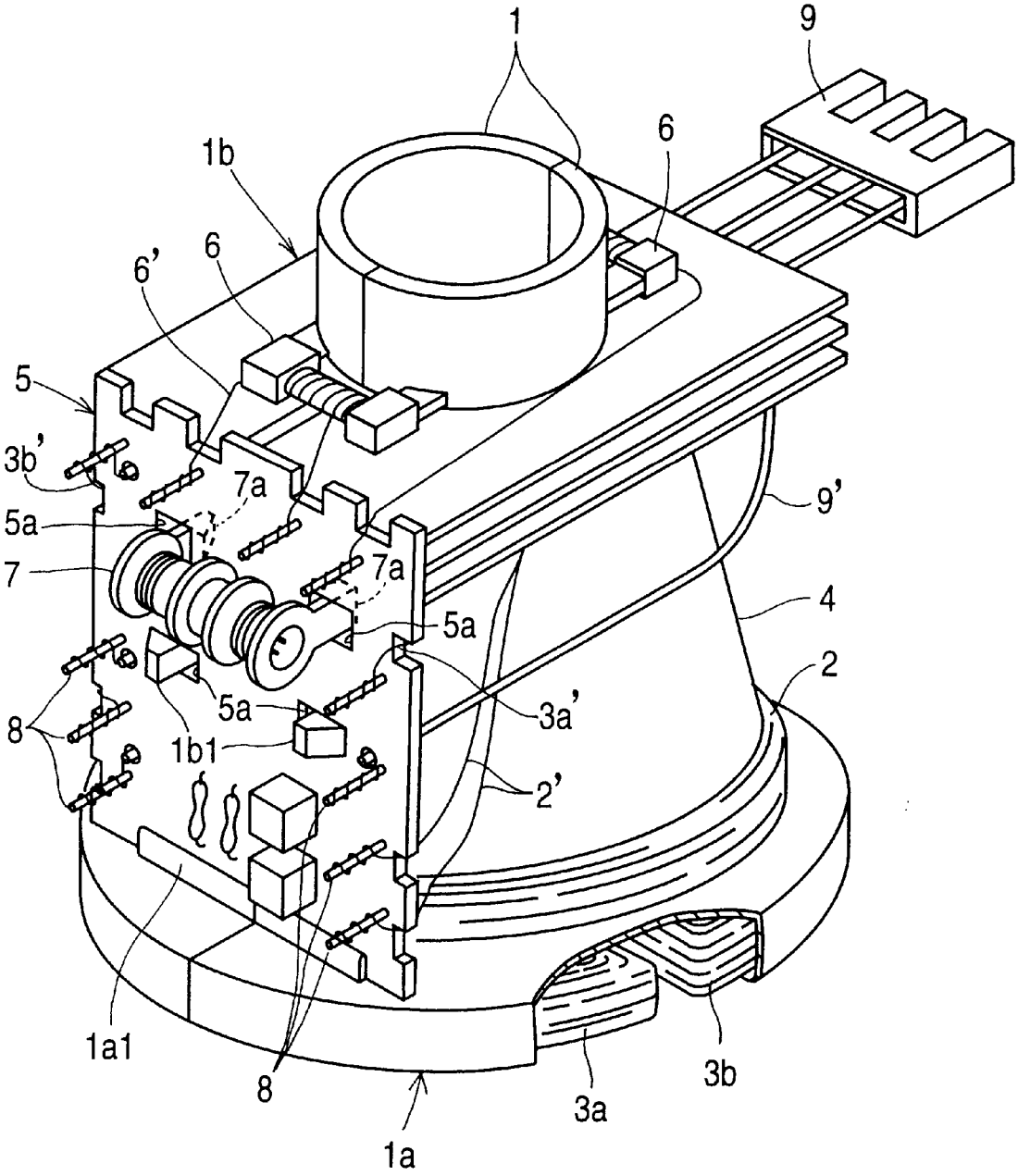
Fig. 1 PRIOR ART
FIG. 1 is a partially cutaway view in perspective of a deflection yoke device in the prior art.
Figure 2:
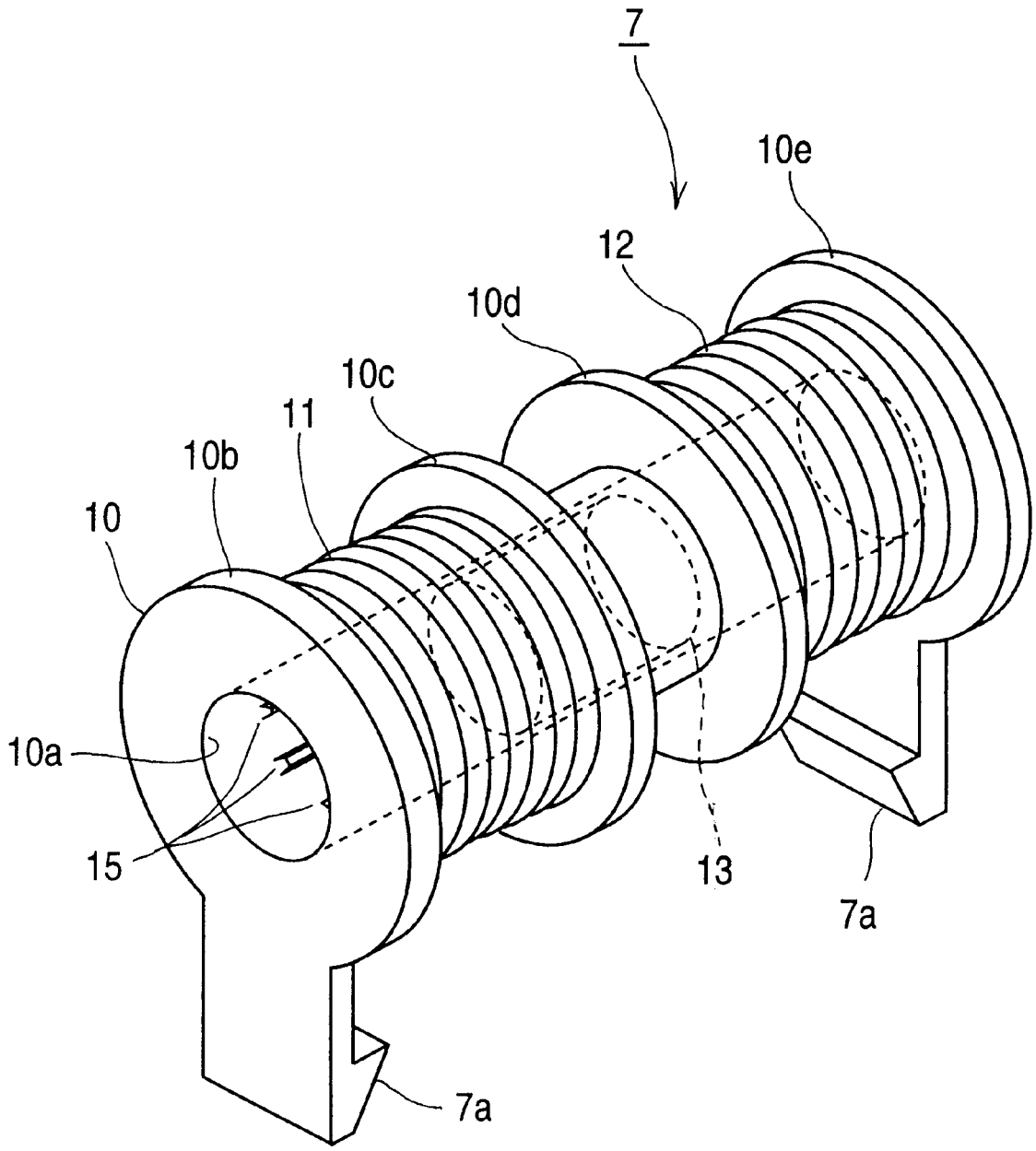
Fig. 2 PRIOR ART
FIG. 2 is a perspective view showing a compensation coil shown in FIG. 1.
Figure 3:
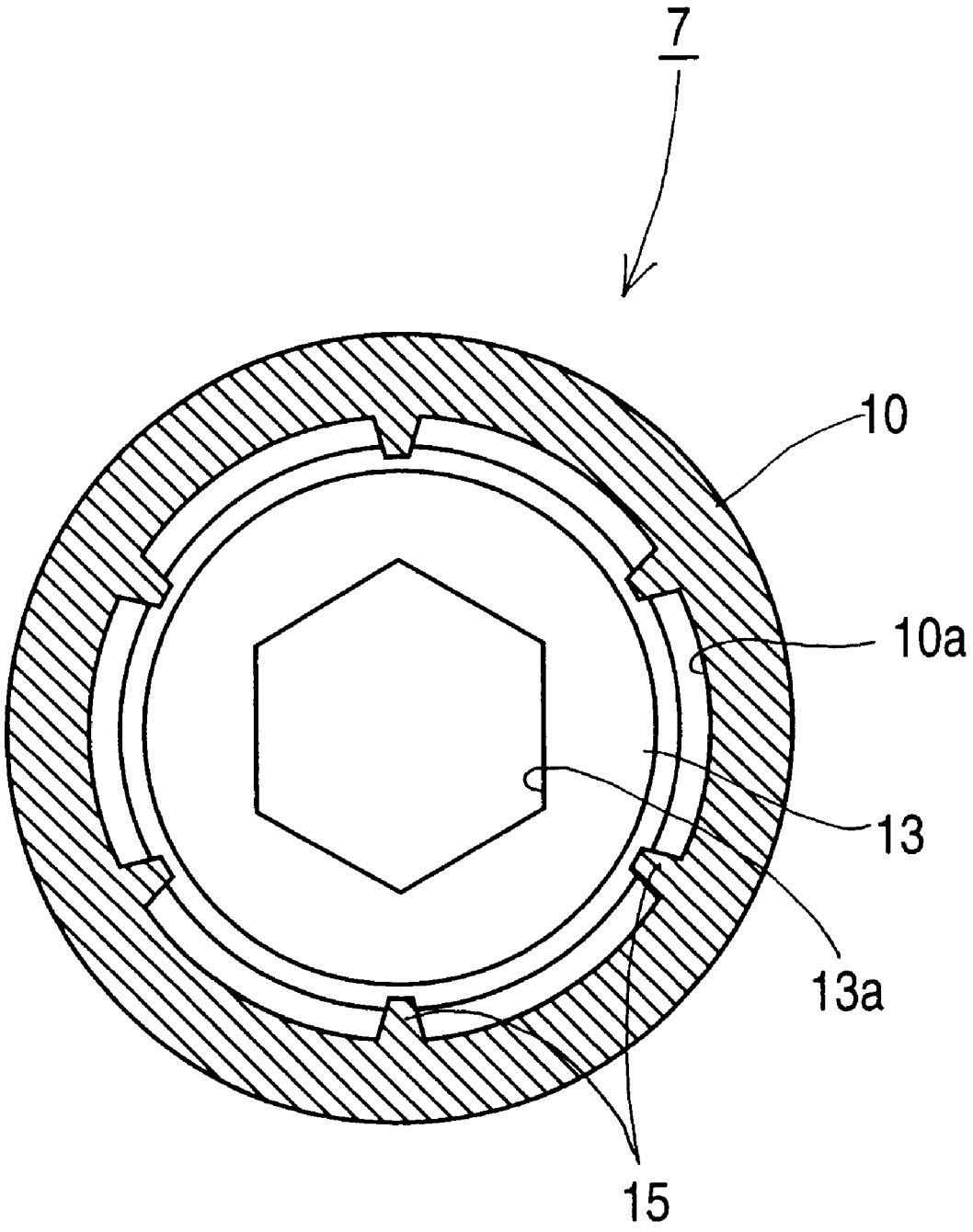
Fig. 3 PRIOR ART
FIG. 3 is a sectional view showing the compensation coil shown in FIG. 2.
Figure 4:
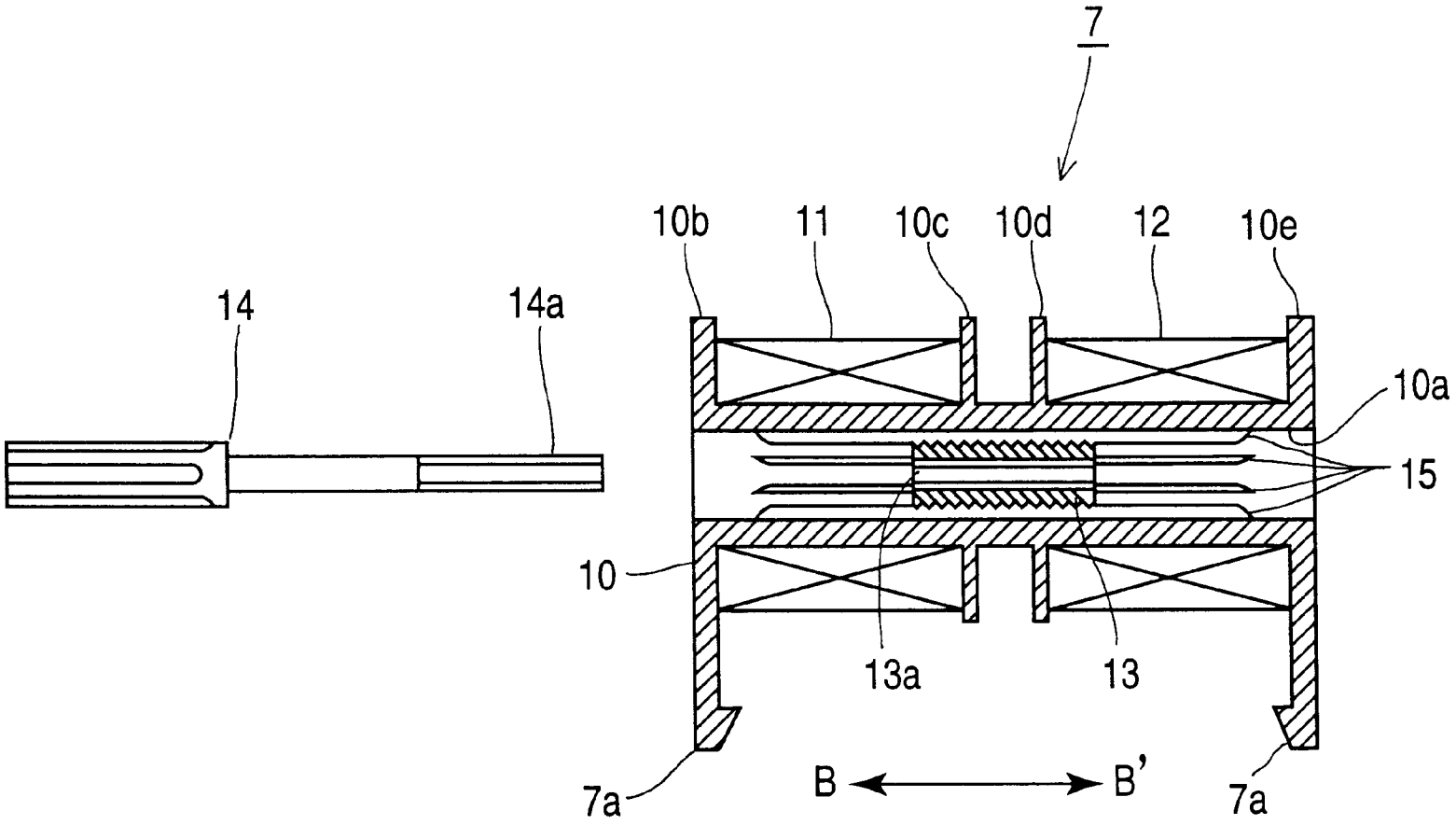
Fig. 4 PRIOR ART
FIG. 4 is a sectional view of the compensation coil for explaining an installment operation of a screw core to a bobbin of the compensation coil manually.

In the compensation coil 70 having the damping material 17, the screw core 13 never displaces in the hollow 10*a* in the longitudinal direction (the B-B' direction in FIGS. 4 and 14). In addition, the damping material 17 has no adhesion effect. Thus, it is possible to optionally adjust the position of the screw core 13 by rotating it with the jig 14 shown in FIG. 4 even when the damping material 17 is applied to a gap between the bobbin 10 and the screw core 13.

Accordingly, even when the damping material 17 has been applied to the bobbin 10 at the time of delivering the deflection yoke device to the ITC makers, there is no problem for the ITC makers to re-adjust the compensation coil 70. Further it is possible to save the re-adjustment time of the compensation coil 70 because the deflection characteristic is maintained in the same condition as adjusted at the delivery inspection. Thus, the re-adjustment is saved in the display instrument makers.

The damping material 17 may be provided between the bobbin 10 and the screw core 13 as follows.

As shown in FIG. 12, when the screw core 13 is screwed into the hollow 10*a* of the bobbin 10, the damping material 17 may be preliminarily applied to the surface (thread) of the screw core 13. Then, the screw core 13 is inserted into the hollow 10*a* of the bobbin 10 as explained referring to FIGS. 5 and 6, resulting in the damping material 17 applied to all over the hollow 10*a* of the bobbin 10.

Further, as shown in FIG. 13, the damping material 17 may be preliminarily applied to the inner surface of the hollow 10*a*. Then, the screw core 13 is inserted into the hollow 10*a* of the bobbin 10 as explained referring to FIGS. 5 and 6.

Furthermore, the screw core 13 is inserted into the hollow 10*a* of the bobbin 10 to cut the internal thread on the inner surface of the hollow 10*a* without applying the damping material 17 to the surface of screw core 13 or the surface of the hollow b1a. Then, after the screw core 13 has been removed from the hollow 10*a* of the bobbin 10, the damping material 17 may be applied to a gap 18 formed between the projection ribs 15 of the bobbin 10 and the screw core 13.

The existence of the damping material 17 effectively eliminates the problems mentioned in the prior art.

Further, the existence of the damping material 17 between the bobbin 10 and the screw core 13 causes a rotational torque required for rotating the screw core 13 to be consistent, which contributes to a smooth rotation of the screw core 13 and secondarily enables a delicate adjustment of the position of the screw core 13.

As shown in FIG. 12 or 13, in the method that after the damping material 17 is preliminarily applied to the surface of the hollow b1a or the surface of the screw core 13, the screw core 13 is screwed in the hollow 10*a*, the damping material 17 has both an effectiveness to improve the surface characteristics of the thread and an effectiveness to prevent the displacement of the screw core 13 by itself after the screw core 13 has been installed into the hollow 10*a*.

In the embodiment mentioned above, the material used as the damping material 17 is interposed between the bobbin 10 and the screw core 13. The damping material 17 provided between the bobbin 10 and the screw core 13 does not exhibit a lubricating operation but a vibration suppression operation by absorbing the vibration and rotation of the screw core 13. The displacement of the screw core 13 is completely prevented by its vibration control function.

Accordingly, it is possible to employ a material other than the aforementioned silicone oil as long as it provides the same function or effectiveness as that of the silicon oil. As a liquid material, an oil such as mineral, ester, α-olefin or fruoro oil, and vegetable or animal oil are available. Further, as other examples, many kinds of materials used for medicine or cosmetic are available.

As gel materials, greases such as mineral, ester, α-olefin or fruoro oil, and vegetable or animal grease are available.

As an example of the fruoro grease, there is BARRI ERTA L55/2 (NOK Kruber INC). Further, as other examples, it is possible to employ many kinds of materials used as medicine and cosmetics.

As mentioned above, the liquid or gel material is preferable, however, a solid material can be used as long as it provides the same effect and function.

For example, it is considered that a powder of a solid material is printed on the Inner surface of the bobbin 10 or on the surface of the screw core 13 as a coated layer. As one of the examples, the powder of a fruoro compound is printed on the surface of the screw core 13 as the coated layer.

According to experiments of the present inventors, it is confirmed that when a solid coated layer is formed on the surface of the screw core 13 by printing the powder of the fruoro compound, the rotation of the screw core 13 of the compensation coil 70 can be prevented in the case where the vibration is applied to the compensation coil 70.

Further, there is another method that after a solvent in which a solid material is resolved, is coated on the inner surface of the bobbin 10 or the surface of the screw core 13, the solvent is removed or volatilized, resulting in the solid material residing between the bobbin 10 and the screw core 13 capable of preventing the rotation of the screw core 13 by itself.

In the embodiment explained above, the projection ribs 15 are formed on the inner surface of the bobbin 10, and the screw core 13 is supported in the bobbin 10 by means of the projection ribs 15, however, the construction of the compensation coil 70 is not limited to this embodiment.

As shown in FIG. 15 (A), the bobbin 10 may have a self-tap structure without the projection ribs 15, wherein upon screwing the screw core 13 in the hollow 10*a*, an internal thread is formed in the inner surface of the bobbin 10 by screwing the screw core 13 in the hollow 10*a*.

Figure 15B:
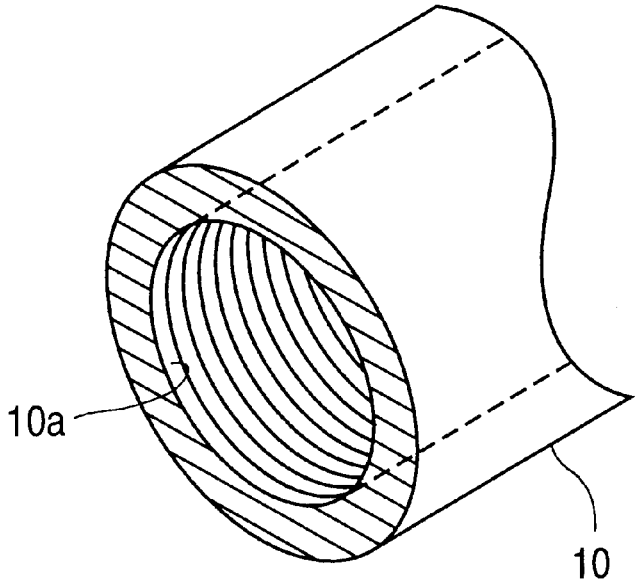

Further, as shown in FIG. 15(B), the internal thread may be preliminarily formed on the inner surface of the bobbin 10.

As mentioned in detail, in the deflection yoke device of the present invention, there is provided the damping material or the liquid or gel material or a solid material for preventing the rotation of the screw core 13 by itself held in the bobbin 10. Thus, it is possible to prevent the displacement of the screw core 13 when an external disturbance such as a vibration or a shock is applied to the deflection yoke device at the transportation thereof.

Accordingly, it is possible to eliminate the problem that the deflection characteristic of the deflection yoke device is deviated while the deflection yoke device or the ITC product is transported.

Therefore, it is possible for the ITC makers or the display instrument makers to save the extra adjusting work. Further, unlike methods employing adhesives, it is possible to re-adjust the position of the screw core 13 after delivering the deflection yoke device.

Further, the presence of the damping material interposed between the bobbin 10 and the screw, core 13 causes a rotational torque for rotating the screw core 13 to be consistent, which contributes to a smooth rotation of the screw core 13 and secondarily enables a delicate adjustment of the position of the screw core 13 by rotating it.

[Second embodiment]

Figure 16:
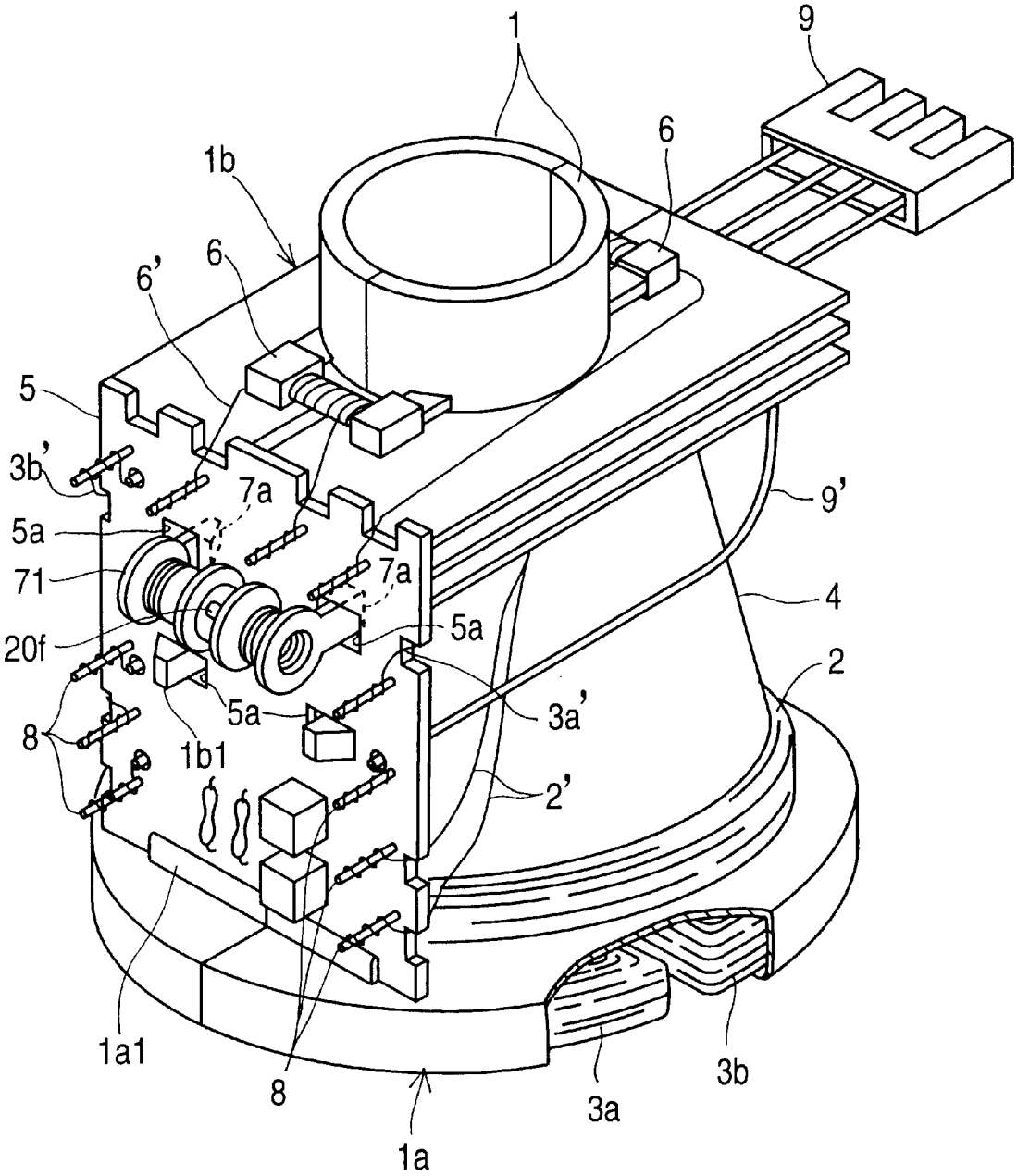
FIG. 16 is a perspective view of a deflection yoke device of a second embodiment of the present invention.
Figure 17:
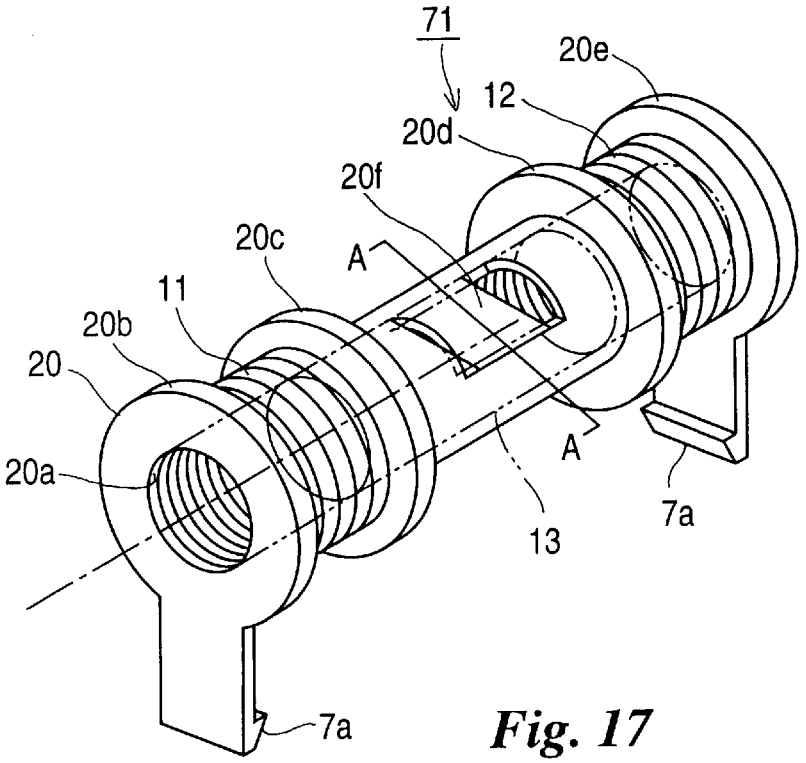
FIG. 17 is a perspective view of the compensation coil shown in FIG. 16, which is one of the main parts of the second embodiment of the present invention.
Figure 18:
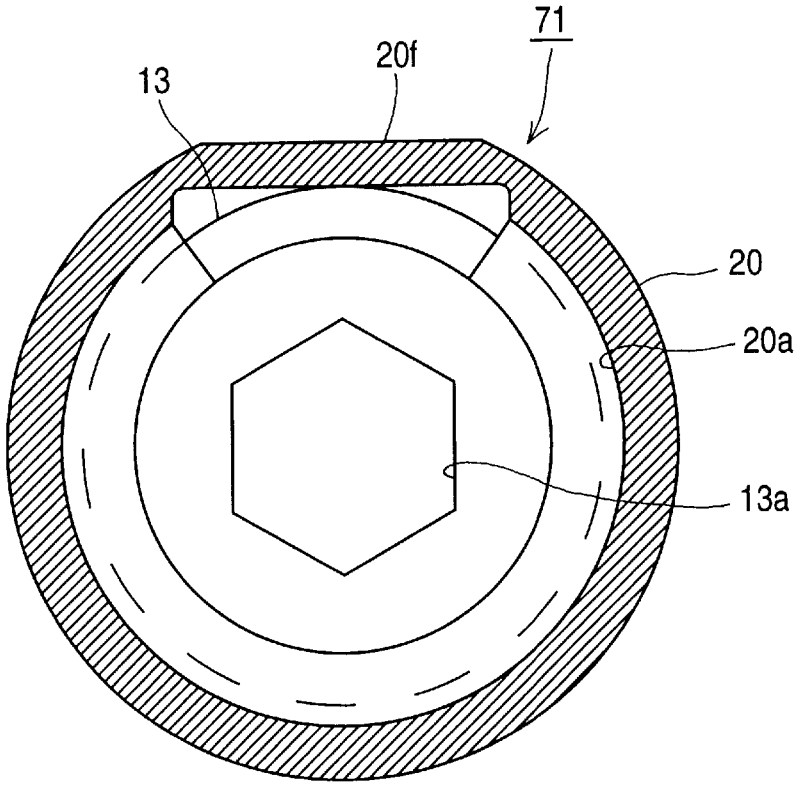
FIG. 18 is a sectional view along an A—A line shown in FIG. 17.
Figure 19:
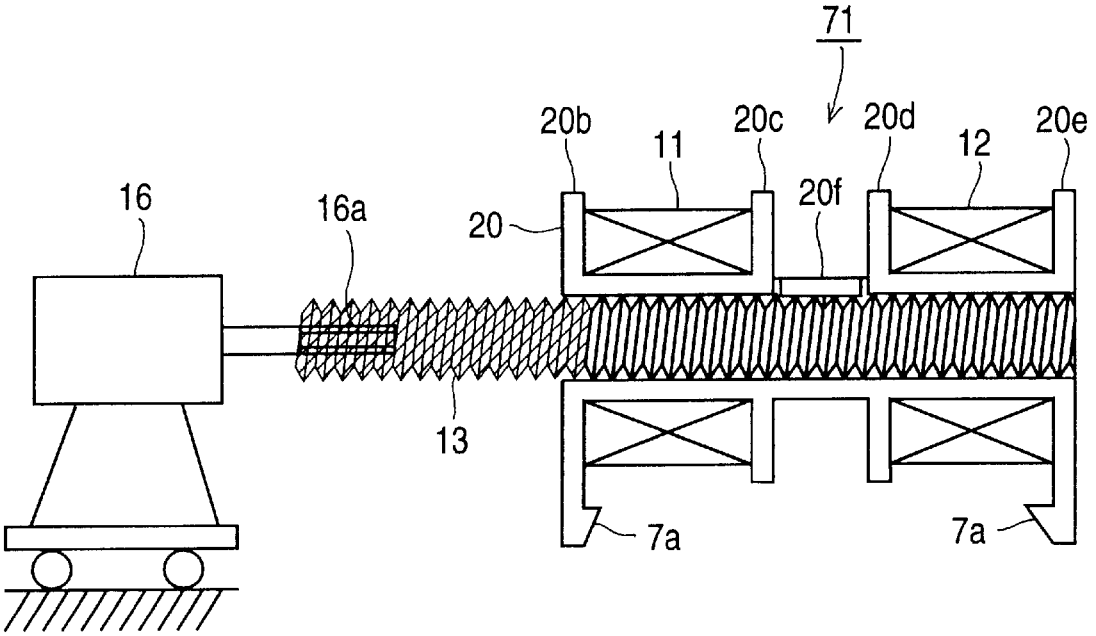
FIG. 19 is a sectional view of starting point of the compensation coil for explaining an installment operation of the screw core to a bobbin of the compensation coil by an automatic machine.
Figure 20:
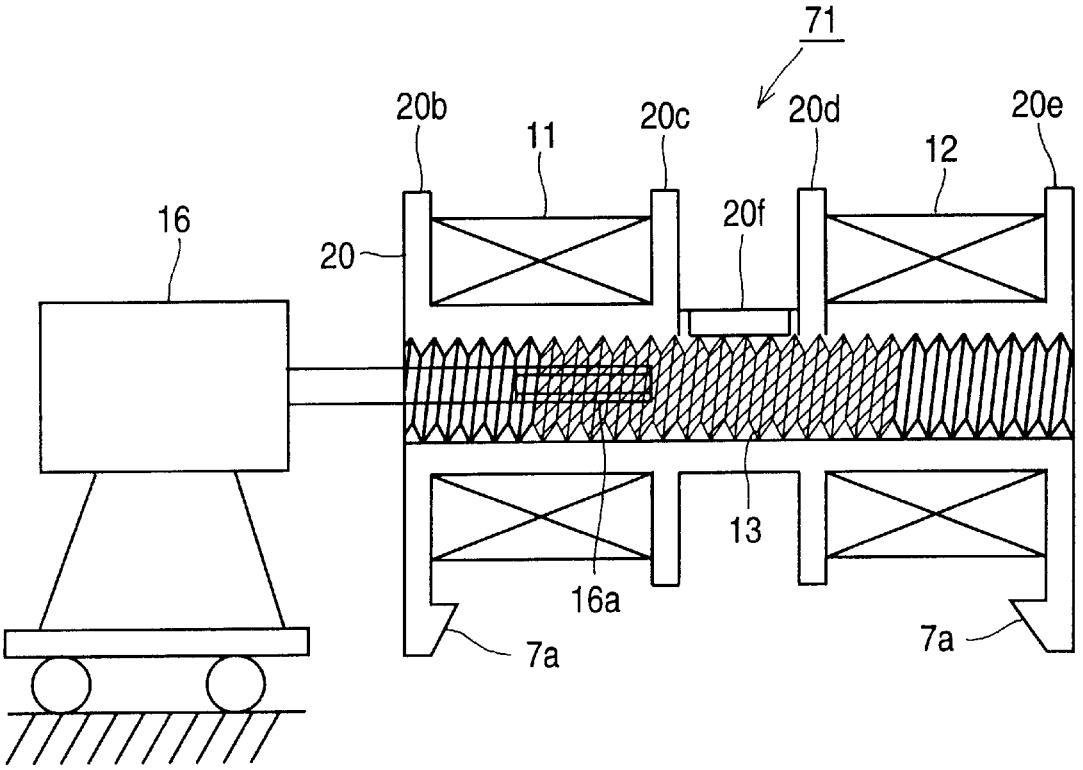
FIG. 20 is a sectional view of ending step of the compensation coil for explaining the installment operation of the screw core to the bobbin of the compensation coil by the automatic machine.
Figure 21:
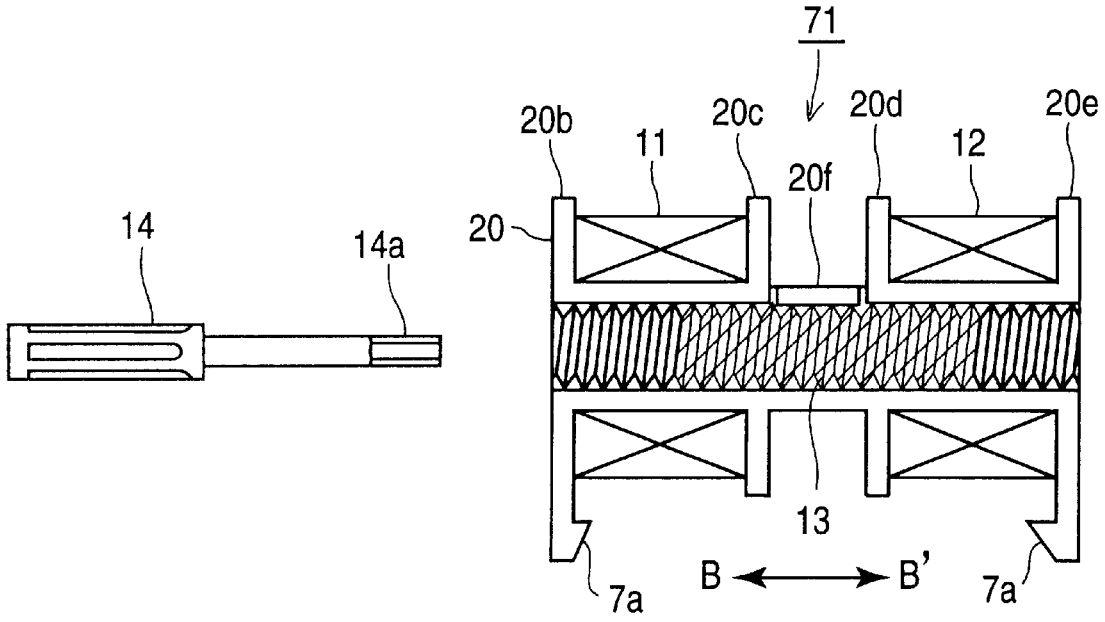
FIG. 21 is a sectional view the compensation coil for explaining a handworked installment operation of the screw core to the bobbin of the compensation coil.

FIG. 16 is a perspective view of a deflection yoke device of a second embodiment of the present invention:

FIG. 17 is a perspective view of a compensation coil shown in FIG. 18, which is one of the main part of the second embodiment of the present invention;

FIG. 18 is a sectional view of the compensation coil of FIG. 17 cut along an A—A line shown in FIG. 17;

FIG. 19 is a sectional view of the compensation coil for explaining an installment operation of the screw core to a bobbin of the compensation coil by an automatic machine;

FIG. 20 is a sectional view of the screw core for explaining the installment operation of the screw core to the bobbin of the compensation coil by the automatic machine;

FIG. 21 is a sectional view of the screw core for explaining a handworked installment operation of the screw core to the bobbin of the compensation coil; and FIGS. 22 to 25 are sectional views showing modifications of the second embodiment.

In FIGS. 16 to 25, the same components as shown in FIGS. 1 to 15 are represented with the same reference characters.

First, the description is given of an overall construction of a deflection yoke device of the second embodiment of the present invention.

In FIG. 16, a pair of horizontal deflection yoke coils 3*a*, 3*b* and a pair of vertical deflection yoke coils 2, each wound in a saddle shape, are respectively provided on inner and outer surfaces of a separator 1 having a cone shape for supporting these vertical and horizontal deflection yoke coils 3*a*, 3*b*, and 2, and for electrically insulating the vertical and horizontal deflection yoke coils 3*a*, 3*b* and 2 from each other. Further, a core 4 made of a magnetic material such as ferrite covers an outside of the vertical deflection coils 2.

In the deflection yoke device, it is needed a circuit for compensating a deflection characteristic. A printed circuit board 5 for mounting such a circuit and electric parts is provided on a side portion of the separator 1, for instance, being extended from a first flange section 1*a* having a large diameter to a second flange section 1*b* having a smaller diameter.

On the printed circuit board 5, there are defined a plurality of approximately rectangular holes 5*a*. The printed circuit board 5 is fixed on the side section of the separator 1 by causing an end portion thereof to engage with an engage section 1*a*1 integrally formed on the first flange section 1*a* and causing the rectangular holes 5*a* to engage with nails 1*b*1 integrally formed on the second flange section 1*b*.

On the printed circuit board 5, there is also mounted a compensation coil 71 for compensating a misconvergence as explained in the foregoing. Specifically, the compensation coil 71 is fixed on the printed circuit board 5 by causing nails 7*a* formed at distal ends thereof in a longitudinal direction to engage with the rectangular holes 5*a*, 5*a* of the printed circuit board 5.

Further on the second flange section 1*b*, there is provided a four pole compensation coil 6 for compensating a coma error, so-called VCR. Here, a reference character 9 denotes a connector for connecting the deflection yoke device to a driving source (not shown).

Furthermore, on the printed circuit board 5, there are erected plural terminals 8 around which leads 2' of the vertical deflection coil 2, leads 3*a*', 3*b*' of the horizontal deflection coils 3*a*, 3*b*, and lead 6' of the four pole compensation coil 6, and lead 9' of the connector 9 are connected and soldered, respectively.

Here, a description is given of a construction and an operation of the compensation coil 71 of the second embodiment.

As shown in FIG. 17, the compensation coil 71 comprises a bobbin 20, coils 11, 12, a screw core 13. On the bobbin 20 made of an insulative material such as plastic resin, there are wound a first coil 11 between the flanges 20*b* and 20*c* to be electrically connected to the horizontal deflection coil 3*a* and a second coil 12 between the flanges 20*d* and 20*e* to be electrically connected to the horizontal deflection coil 3*b*.

In the bobbin 20, there is defined a hollow 20*a* having an approximately cylindrical shape in a longitudinal direction of the bobbin 20. In the hollow 20*a*, there is installed the screw core 13 having an external thread on an outer surface thereof.

Further, on a portion of the bobbin 20 between the flanges 20*c* and 20*d* without the coils 11, 12, there is formed a retainer section 20*f* having, for instant, a plate shape. As shown in FIG. 17, in the inner surface of the hollow 20*a*, an internal thread is preliminarily cut except for the retainer section 20*f*, and the screw core 13 is installed into the hollow at a center of the bobbin 20 in the longitudinal direction thereof.

Next, the description is given of the retainer section 20*f* which is one of the main features of the present invention, referring to FIG. 18. FIG. 18 is a sectional view of the compensation coil 71 cut along an A—A line in FIG. 17. The retainer section 20*f* is integrally formed on an opposite side of nails 7*a*, 7*a* of the bobbin 20 and has an elasticity in a radial direction of the bobbin 20. The inner surface of the retainer section 20*f* is positioned to be inside of the hollow 20*a* to allow the inner surface of the retainer section 20*f* to contact with the external thread of the screw core 13 when the screw core 13 is installed in the hollow 20*a*. Thereby, the screw core 13 is depressed in the radial direction of the bobbin 20 by a spring action of the retainer section 20*f*.

In the deflection yoke device in the prior art, the required rotational torque was generated by the screw core 13 being forcibly fitted in the bobbin 10, where the rotational torque was difficult to be controlled.

On the other hand, in the compensation coil 71 of the present invention, except at the position of the retainer section 20*f*, the screw core 13 is loosely fitted in the hollow 20*a* of the bobbin 20. Thus, the screw core 13 is given a predetermined rotational torque by being pressed with the biasing force of the retainer section 20*f*.

Accordingly, even when a vibration or an external shock is applied to the compensation coil 71, the displacement of the screw core 13 is prevented.

Further, as shown in FIG. 18, the screwed core 13 is defined with a hexagonal hole 13*a* penetrating in the longitudinal direction of the bobbin 10.

When the screwed core 13 is installed in the hollow 20*a*, the screwed core 13 is automatically installed into the bobbin 20 from one end of the bobbin 20 by the automatic machine 16 shown in FIG. 19 like in the prior art.

As shown in FIG. 20, first, the screwed core 13 is screwed into the hollow 20*a* from one end of the bobbin 20. Then, the screwed core 13 is rotated to be positioned approximately at a center of the bobbin 20 in the longitudinal direction.

As shown in FIG. 21, the screw core 13 may be manually installed in the bobbin 20 with the jig 14.

At that time, as the internal thread is preliminarily cut in the inner surface of the hollow 20*a* of the bobbin 20, it is not necessary to rotate the screwed core 13 up to the distal end of the hollow 20*a*, then to reverse the rotation so as to be approximately positioned at the center of the bobbin.

The compensation coil 71 constructed as mentioned above is installed on the deflection yoke device as explained referring to FIG. 16, and is electrically connected to the horizontal deflection coils 3*a*, 3*b* as shown in FIG. 7.

Specifically, the horizontal deflection coils 3*a*, 3*b* are connected in parallel to each other and between a plus terminal (+) and a minus terminal (−), and coils 11, 12 of the compensation coil 71 and the horizontal deflection coils 3*a*, 3*b* are all connected in series as shown in FIG. 7. Upon the operation of the deflection yoke device, the currents I*a*, I*b* flow through the horizontal deflection coils 3*a*, 3*b*, respectively.

When the screw core 13 is displaced in the longitudinal direction of the compensation coil 71, respective inductances L11, L12 of the coils 11, 12 are differentially changed.

Thereby, the currents I*a* and I*b* flowing through the horizontal deflection coils 3*a*, 3*b* are adjusted and a magnetic field generated by the horizontal deflection coils 3*a*, 3*b* is controlled. As a result, a displacement amount Xv of a red line from a blue line, which is one of the misconvergences shown in FIG. 8, is compensated.

In the compensation coil 71 of the present invention, as the internal thread is preliminarily cut in the inner surface of the hollow 20*a* of the bobbin 20, it is not necessary to cut the external thread in the installing process of the screw core 13.

As the screw core 13 is loosely fitted with the internal thread cut in the inner surface of the hollow 20*a* of the bobbin 20, there is no possibility that the internal thread is damaged or worn out by the reciprocating motion of the screw core 13. Thus, the decrease of the rotational torque is prevented. Further, there is no problem of chipping or cracking of the screw core 13.

Further, it is possible to control a desired rotational torque for the screw core 13 for rotating the screw core 13 by designing the position of the inner surface of the retainer section 20*f* in the radial direction of the bobbin 20 or controlling an elasticity of the retainer section 20*f*. Thereby, it is possible to cause the retainer section 20*f* to press the screw core 13 with a desirable force in the radial direction of the bobbin 20. As a result, it is possible to obtain a consistent and an optimum rotational torque for rotating the screw core 13 smoothly, which enables a delicate adjustment of the screw core 13, resulting in an increase of the working efficiency.

In the compensation coil 71 having the retainer section 20*f*, the retainer section 20*f* prevents the screw core 13 from displacing in the longitudinal direction (the B-B' direction in FIGS. 7 and 21) caused by the external vibration or the shock at the delivery of the deflection yoke device, resulting in an easy adjustment for the worker.

Accordingly, the adjustment in the ITC maker becomes an easy one. In addition, the deflection characteristics of the deflection yoke device adjusted at the delivery maintains as it is, resulting in a save of working time or an elimination of extra works. Accordingly, the re-adjustment process is eliminated in the display equipment maker.

Next, an explanation is given of the modifications of the compensation coil 71 in the second embodiment, referring to FIGS. 22 to 25.

Figure 22:
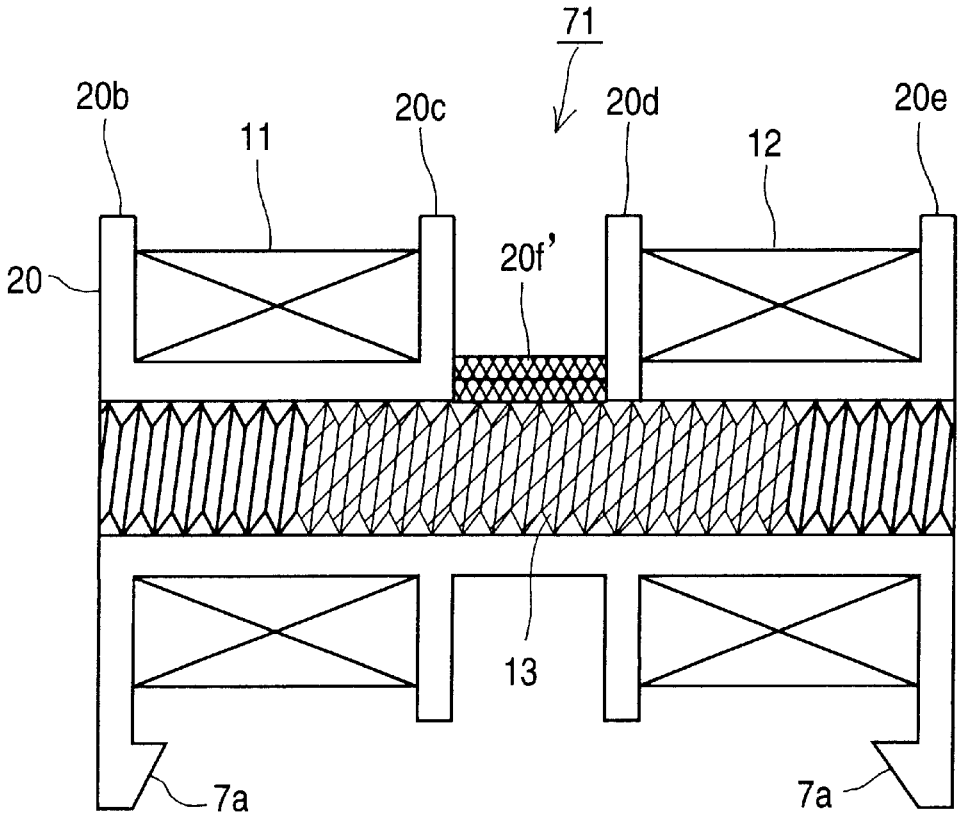
FIGS. 22 to 25 are sectional views showing modifications of the second embodiment.

In the compensation coil 71 shown in FIG. 22, the retainer section 20*f* is made of a separated retainer section 20*f*', not integrally formed with the bobbin 20. The separated retainer section 20*a*' is connected to the bobbin 20 by known connecting means. Thereby, the same operation and effectiveness can be obtained.

Figure 23:
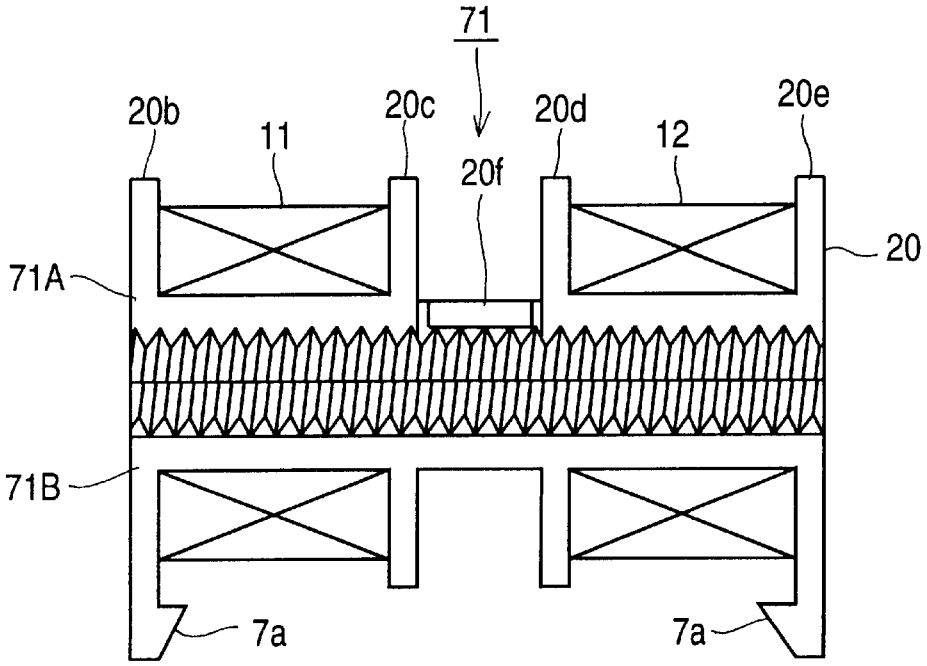

Incidentally, in the compensation coil 71 shown in FIG. 17, it may be difficult to integrally mold the bobbin 20 from resin. In order to eliminate the difficulty, the bobbin 20 of the compensation coil 71 of this modification is divided into two halves 71A, 71B in a longitudinal direction as shown in FIG. 23, each individually being molded. Then, the two halves 71A, 71B are assembled together into the bobbin 20 as shown in FIG. 17. Here, the retainer section 20*f* is formed in the half 71A. Further, the screw core 13 is not depicted here.

As mentioned above, when the bobbin 20 of the compensation coil 71 is made of the two halves 71A, 71B, it is easy to fabricate the compensation coil 71 by placing the screw core 13 in the one half 71B having no retainer section and then covering the screw core 13 with the other half 71A having the retainer section 20*f*. Thereby, the screw core 13 can be positioned at the center of the compensation coil 71. This saves the troublesome process of insertion of the screw core 13 to the bobbin 20, resulting in an improvement of the working efficiency. Needless to say, it is possible to connect the two halves 71A, 71B with a hinge.

When the bobbin 20 is made of the two halves 71A, 71B, each having the internal thread in its inner wall, it is possible that the internal threads of the two halves 71A, 71B may not be aligned with in the longitudinal direction of the bobbin 20 when assembled.

Figure 24:
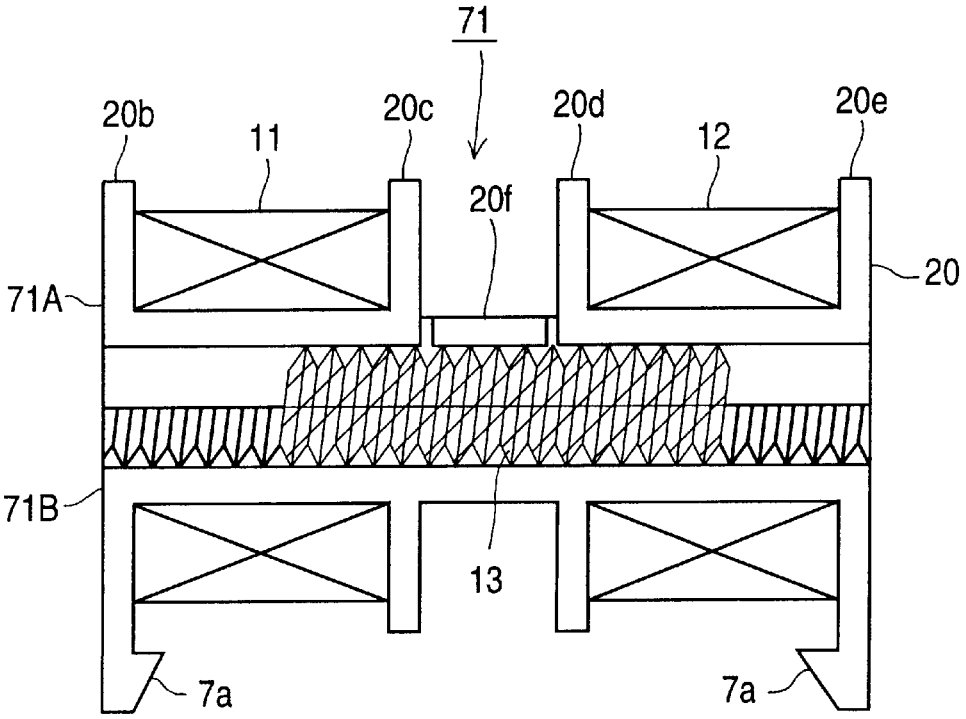

In this modification, the internal thread is cut, for instance, only on the inner wall of the half 71B having no retainer as shown in FIG. 24. This construction eliminates the problem of out of alignment of the internal threads, even when the two halves 71A, 7B are assembled being shifted from each other in the longitudinal direction.

Here, the internal thread is cut only on the half 71B, however, it is possible to cut the internal thread only on the other half 71A having the retainer section 20*f*. In this case, the internal thread is cut on the portion except for the retainer 20*f*.

As mentioned above, in the compensation coil 71 where the internal thread is cut only on either the half 71A or the half 71B, there is no inconvenience to displace the screw core 13 for adjustment.

As seen from the above description, in order to facilitate molding of the bobbin 20 by using a resin and the installment work of the screw core 13, it is preferable to use the two halves 71A, 71B and to cut the internal thread on either the half 71A or the half 71B.

Figure 25:
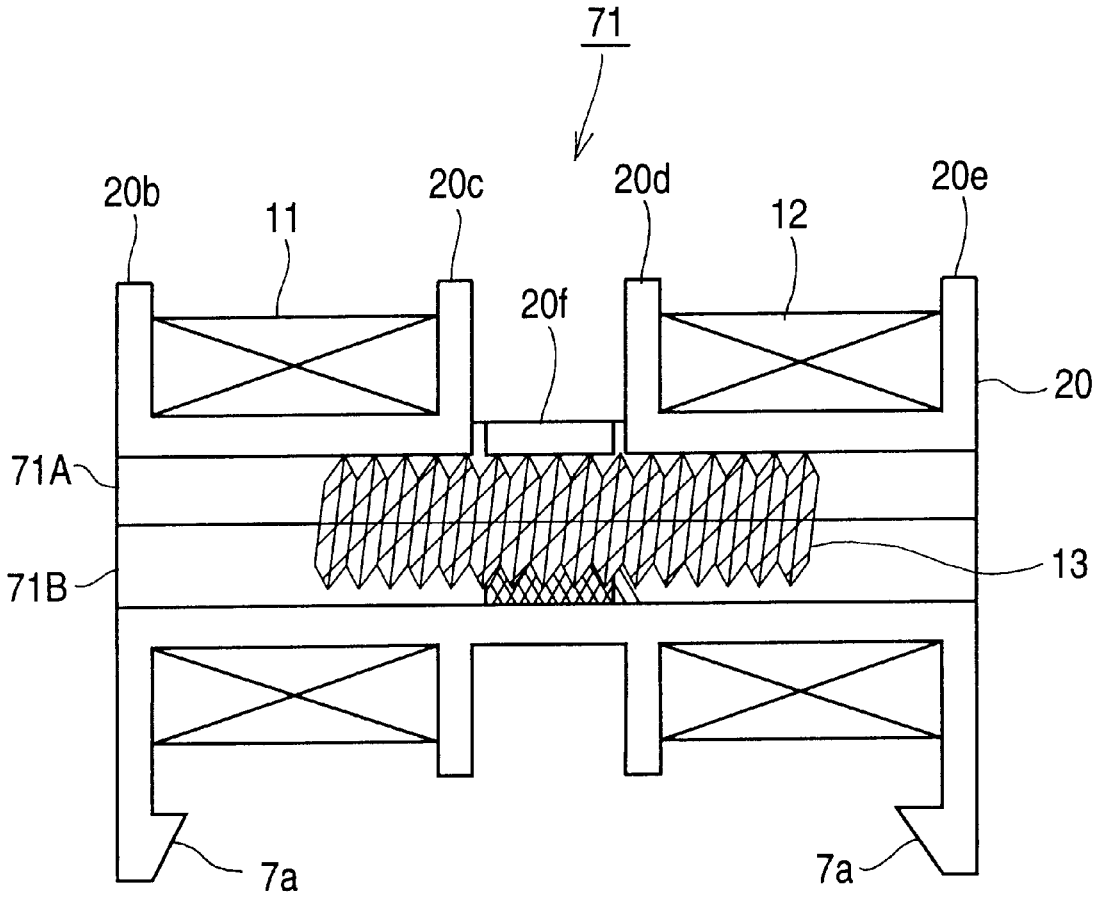

Further, the internal thread cut on either the half 71A or the half 71B does not need to be provided all over the inner surface of the half 71A or 71B in the longitudinal direction, but on one portion thereof. The screw core 13 is displaced within a range nearby a center portion in the longitudinal direction (B-B' direction in FIG. 21). Thus, as shown in FIG. 25, the internal thread may be cut on the half 71B at a center portion thereof opposite to the retainer section 20*f*.

While the presently preferred embodiments of the present invention have been shown and described, it is to be understood these disclosures are for the purpose of illustration and that various changes and modification may be made without departing from the scope of the invention as set forth in the appended claims.

In the second embodiment, the retainer section 20*f* is made of a straight plate but it is possible to employ a curved plate. Further, a resilient member such as a coil spring or a plate spring can be used as the retainer section 20*f*.

It is to be understood that all the constructions where the bobbin 20 and the screw core 13 are loosely fitted and the screw core 13 is pressed by a predetermined retainer section, are included in the scope of the present invention.

Further, in the present invention, the compensation coil for compensating the misconvergence is explained, however, the construction in the present invention can be applied to all the compensation coils where the screw core is installed in the cylindrical bobbin and the position of the screw core is adjusted.

Specifically, it can be applied to the adjustment coil disclosed in Japanese Patent Laid-open Publication 7-162880, or a variable inductance coil for compensating the misconvergence, so-called XH, disclosed in Japanese Patent Laid-open Publication 9-211403 and Japanese Patent Laid-open Publication 9-331163.

As mentioned above, in the deflection yoke device of the present invention comprising an approximately cylindrical bobbin having a coil thereon and a hollow formed with an internal thread on an inner surface thereof and a screw core which is installed in the hollow and is displaced in the longitudinal direction, a retainer section for pressing the screw core is provided on a part of the bobbin. Thus, an undesired change of the position of the screw core in the bobbin due to vibrations caused by transportation is prevented.

Thus, it is possible to eliminate an inconvenience of a change of deflection characteristic of the deflection yoke device by the transportation of the deflection yoke and the products in the ITC state. Thus, the extra adjustment work can be avoided in the ITC maker and the display equipment maker. Further, it enables re-adjustment of the position of the screw core unlike use of the adhesive.

Further, upon adjusting the position of the screw core by rotating, the rotational torque becomes consistent and a smooth operation can be obtained, which enables a delicate adjustment of the screw core. As the screw core has a construction that the rotational torque is given by pushing the screw core with the retainer section, the screw core does not need to be forcibly engaged with the bobbin.

Accordingly, it is no problem of chipping and cracking of the screw core. Further, even when the screw core is repeatedly rotated, the rotational torque is not decreased.

[Third embodiment]

Figure 26:
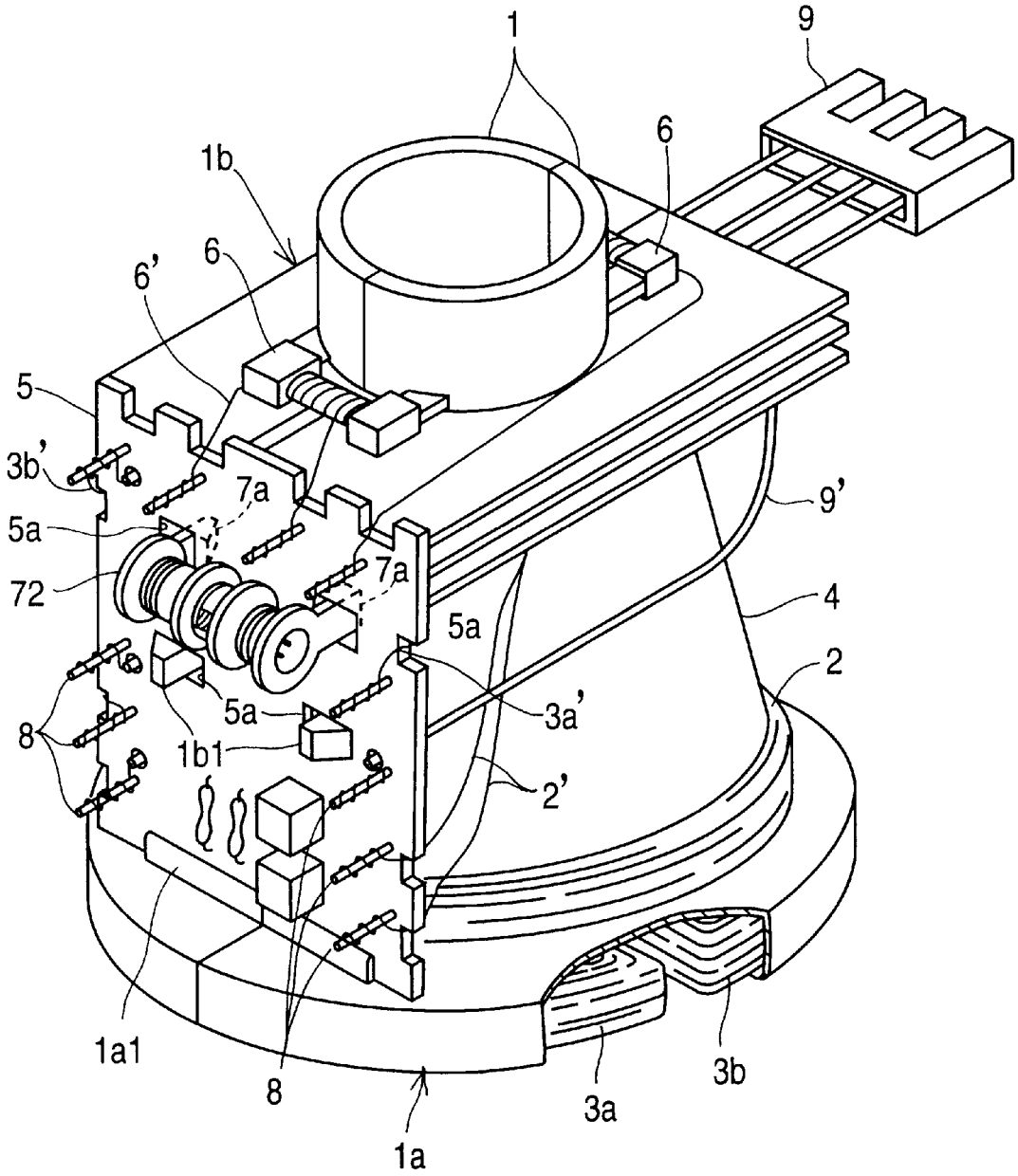
FIG. 26 is a perspective view of a deflection yoke device of a third embodiment of the present invention.
Figure 27:
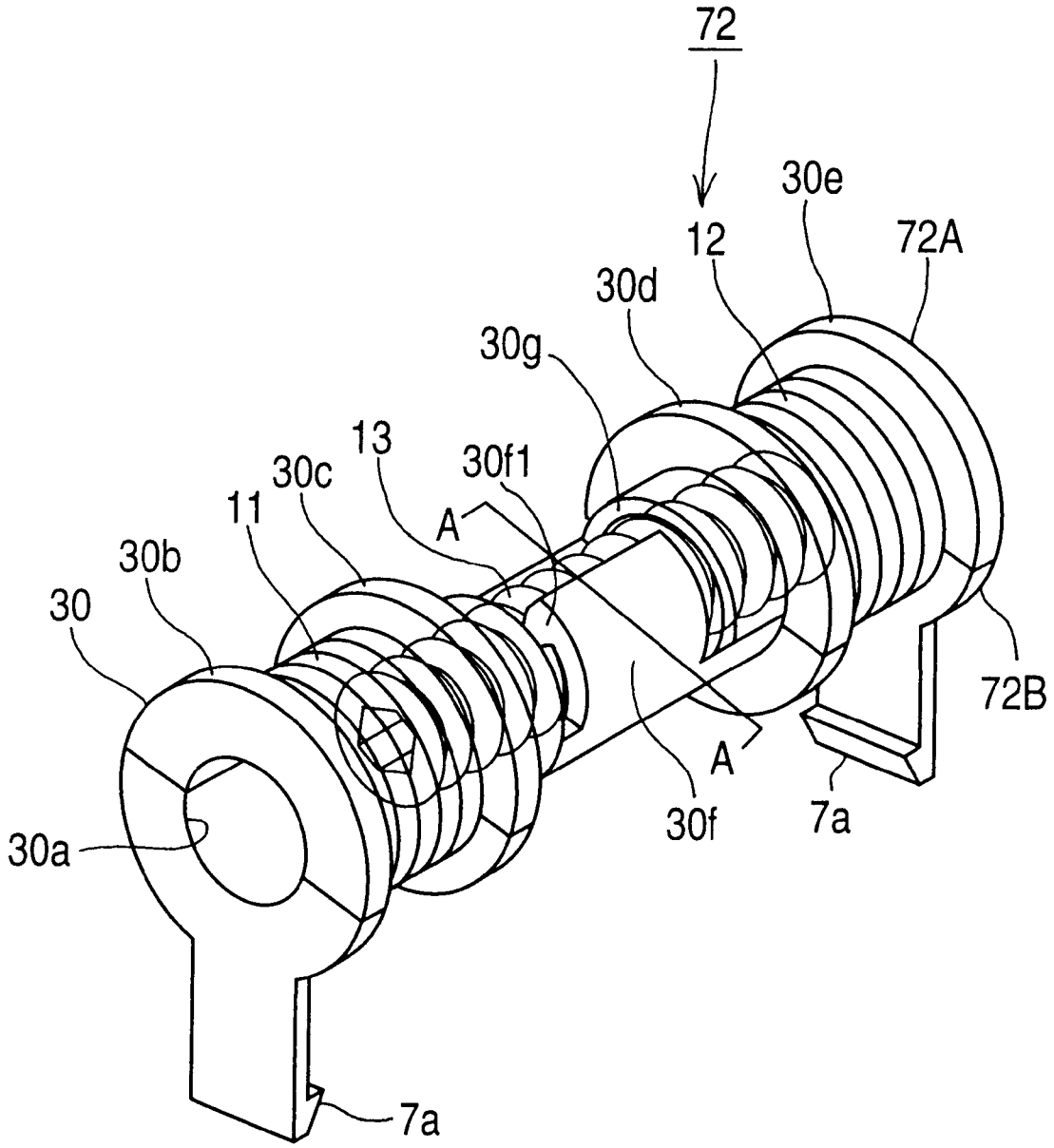
FIG. 27 is a perspective view of the compensation coil shown in FIG. 26, which is one of the main parts of the third embodiment of the present invention.
Figure 28:
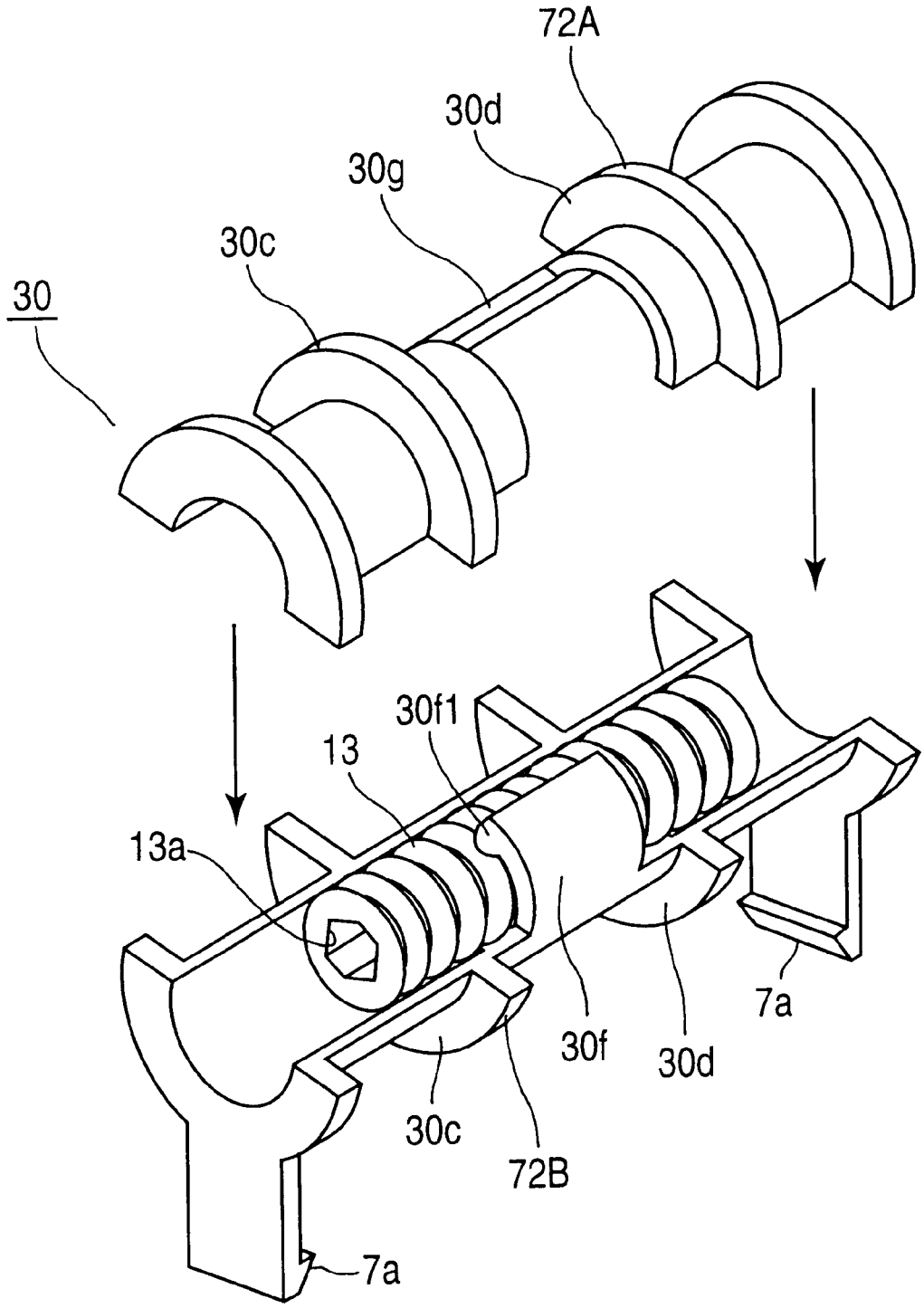
FIG. 28 is an exploded view of the compensation coil shown in FIG. 27.
Figure 29:
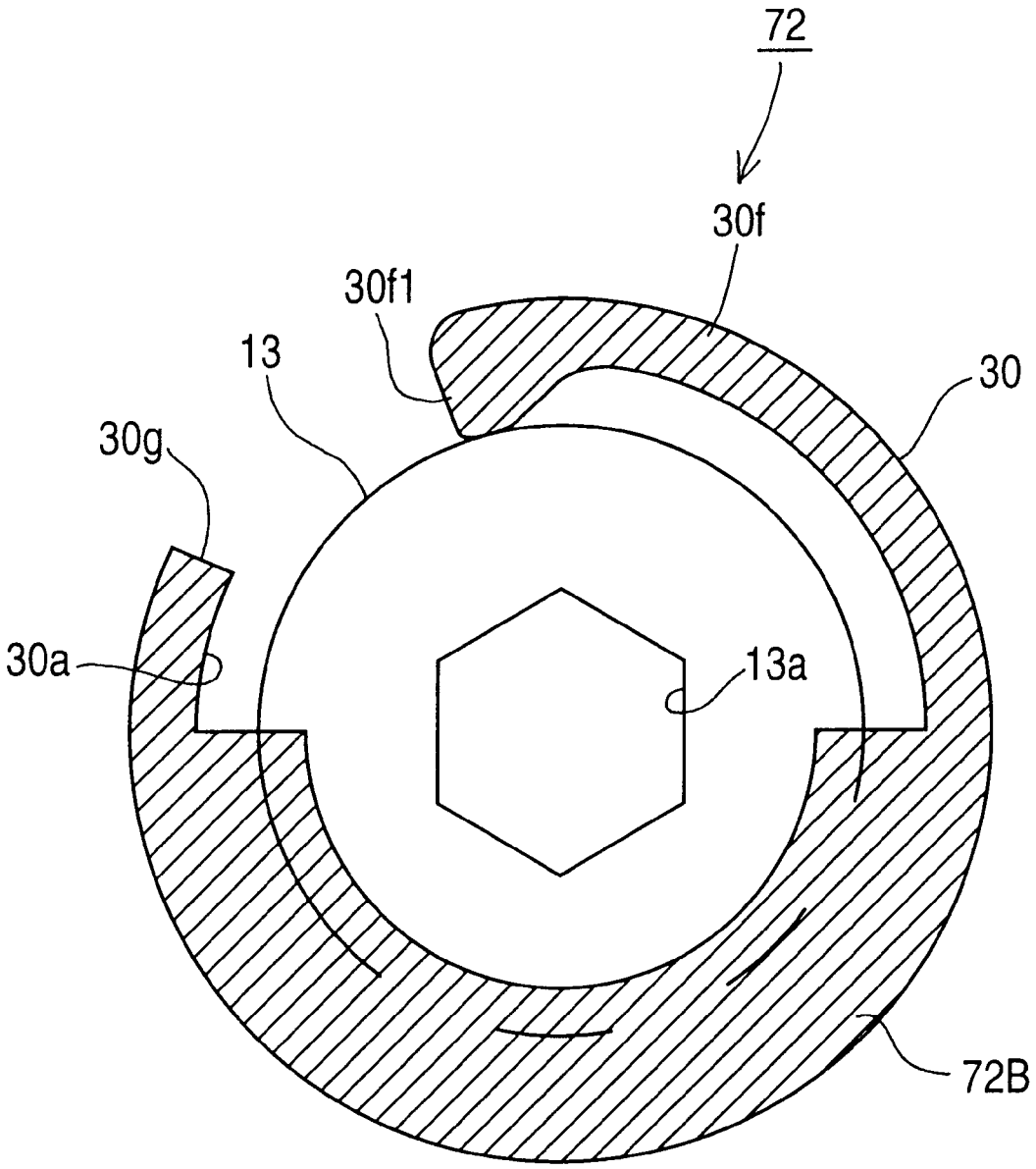
FIG. 29 is a sectional view of the compensation coil shown in FIG. 28.
Figure 30:
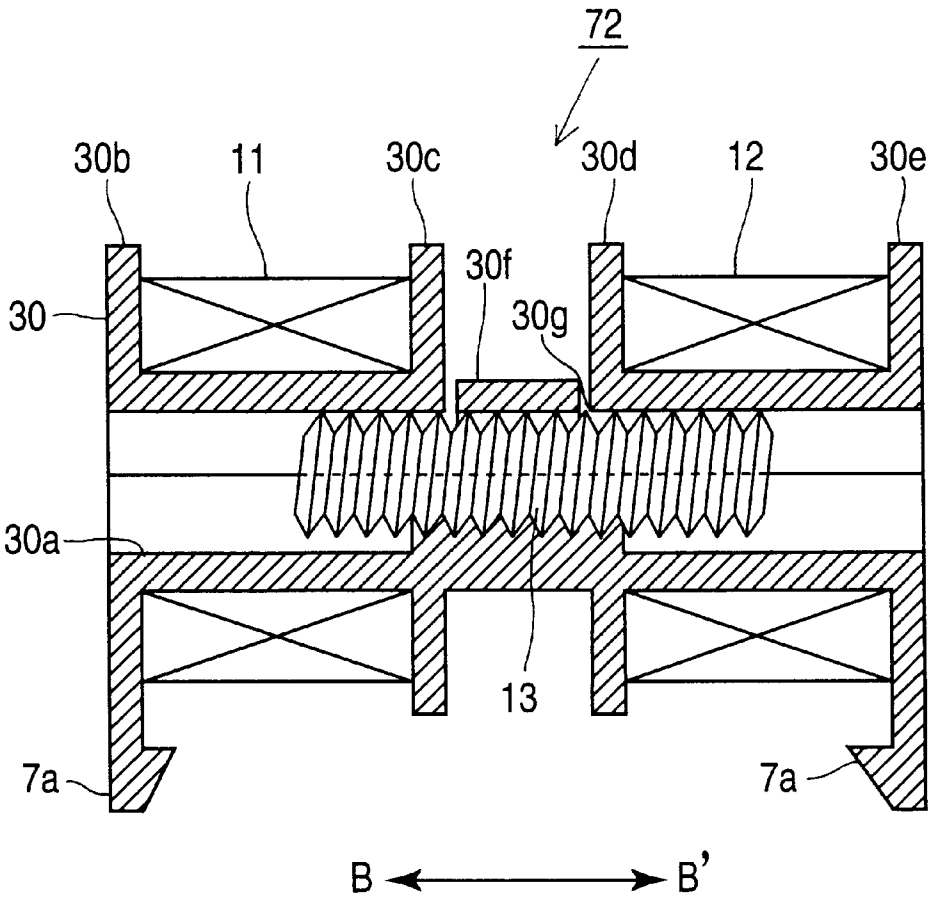
FIG. 30 is a sectional view of the compensation coil for explaining an operation for adjusting a position of the screw core in the bobbin of the compensation coil.
Figure 30:
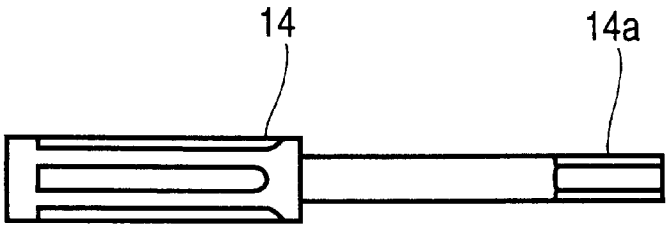
Figure 31:
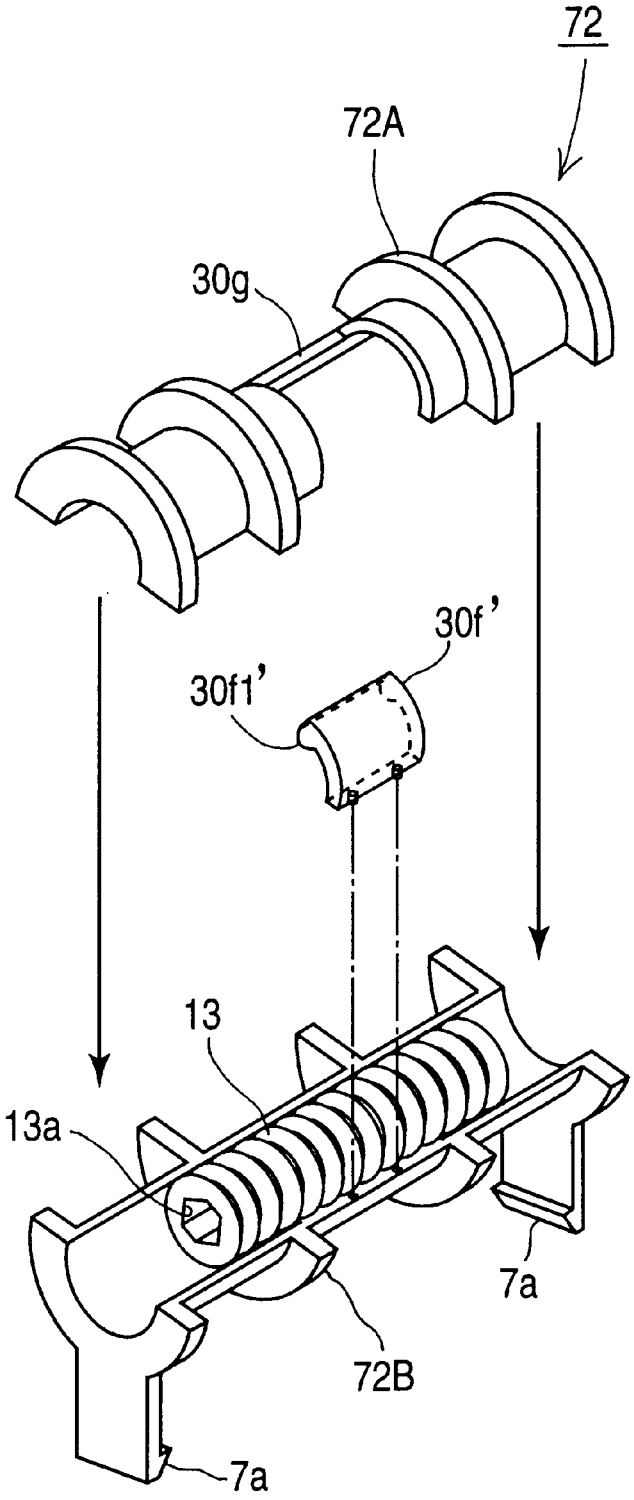
FIG. 31 is an exploded view showing the compensation coil modified from the third embodiment.
Figure 32A:
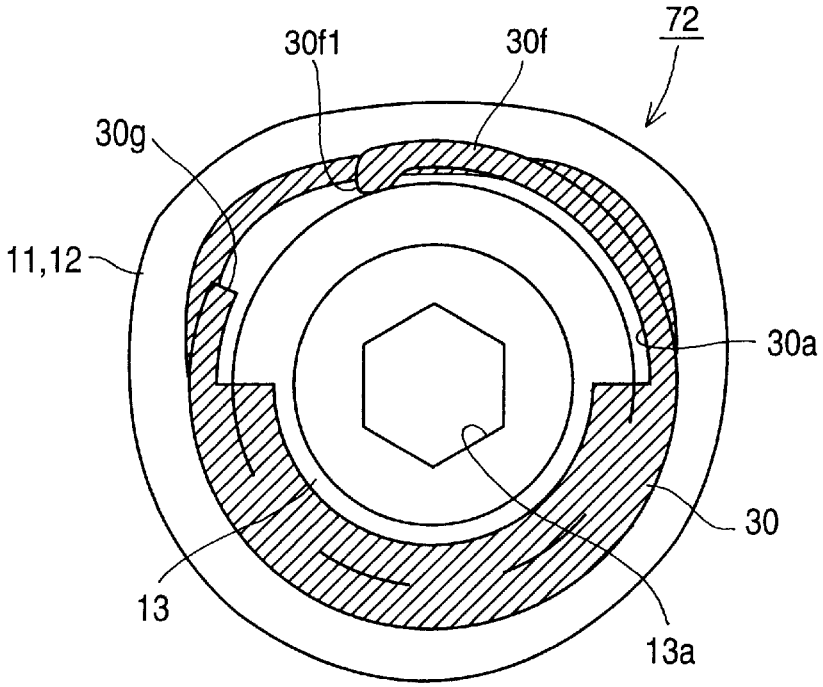
FIGS. 32 (A) and 32 (B) are sectional views of the compensation coil for explaining a deformation of the bobbin when coils are wound around the bobbin.
Figure 32B:
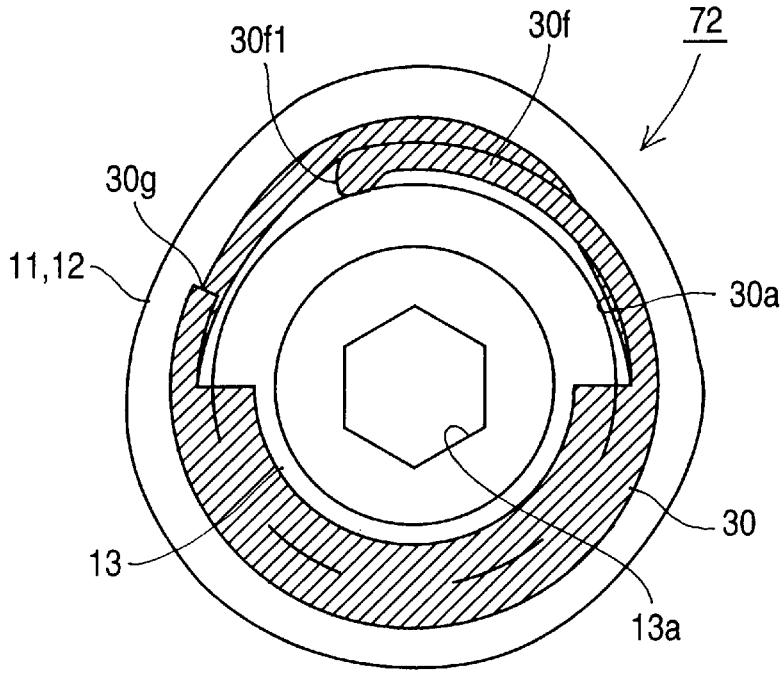

FIG. 26 is a perspective view of a deflection yoke device of a third embodiment of the present invention;

FIG. 27 is a perspective view of a compensation coil shown in FIG. 26, which is one of the main parts of the third embodiment of the present invention;

FIG. 28 is an exploded view of the compensation coil shown in FIG. 27;

FIG. 29 is a sectional view of the compensation coil shown in FIG. 28;

FIG. 30 is a sectional view of the compensation coil for explaining an operation for adjusting a position of the screw core in the bobbin of the compensation coil;

FIG. 31 is an exploded view showing a compensation coil modified from the third embodiment; and FIGS. 32 (A) and 32 (B) are sectional views of the compensation coil for explaining a deformation of the bobbin when coils are wound around the bobbin.

In FIGS. 26 to FIG. 32(B), the same components as shown in FIGS. 1 to 15 are represented with the same reference characters.

As to an overall construction of a deflection yoke device of the third embodiment of the present invention, the compensation coil 71 of the second embodiment is replaced with the compensation coil 72. Thus, a repeated description is omitted here.

As shown in FIG. 27, the compensation coil 72 of the third embodiment of the present invention comprises a bobbin 30, coils 11, 12 and the screw core 13. There are wound the first coil 11 connected to the horizontal deflection coil 3*a* and the second coil 12 connected to the horizontal deflection coil 3*b* are respectively wound around the bobbin 30 between flanges 30*b*, 30*c* and between flanges 30*d*, 30*e*.

The bobbin 30 is formed with a through hollow (referred to as hollow) 30*a* having a cylindrical shape in a longitudinal direction. In the hollow 30*a*, the screw core 13 having an external thread on an outer surface thereof is installed.

As shown in FIG. 28, the bobbin 30 of the compensation coil 72 is comprised of two halves 72A, 72B, wherein the coils 11, 12 are not depicted. The compensation coil 72 shown in FIG. 27 is obtained by assembling the two halves 72A, 72B together.

Further, as shown in FIGS. 27, 28, on a portion of the half 72B having no coil between the flanges 30*c*, 30*d*, there is provided a retainer section 30*f* having a circular arc shape. As shown in FIG. 29, the retainer section 30*f* has an approximate quadrant extended from the half 72B as an integral part thereof.

The retainer section 30*f* has an elasticity, and an protruding portion 30f1 formed at an distal end of the retainer section 30*f* to press the top of the external thread of the screw core 13. On a bottom of the hollow 30*a* of the half 72B, an internal thread is preliminarily cut (not shown), and the screw core 13 is installed at a center portion of the half 72B in the longitudinal direction.

In the compensation coil 72 of the third embodiment, the protruding portion 30f1 is formed at the distal end of the retainer section 30*f*, but the protruding portion 30f1 may be omitted.

Further, in this embodiment, the retainer section 30*f* presses the screw core 13 along a line in the longitudinal direction thereof. The pressing method of the screw core 13 is not limited to this embodiment, however, it is preferable to press the screw core 13 by causing the retainer section 30*f* to contact, at least, two screw threads of the screw core 13.

On the other hand, a cutout 30*g* is provided at a position having no coils between the flanges 30*c*, 30*d* of the half 72A to allow the retainer section 30*f* of the half 72B fitted therein. As the screw core 13 installed in the bobbin 30 is exposed in the cutout, the retainer section 30*f* can press the screw core 13 through the cutout portion 30*g*.

Further, it is possible to cover the cutout portion 30*g* together with the retainer section 30*f* with a roof member integrally provided on the half 72A.

In this embodiment, the screw core 13 is pressed with one retainer section 30*f*, however, plural retainer sections may be provided on the half 72B.

In this case, plural retainer sections are positioned in the cutout portion, however, it is possible to allow the respective plural retainer sections to be positioned in respective plural cutout portions.

Next, the description is given of the retainer section 30*f* referring again to FIG. 29. The protruding portion 30*f*1 of the retainer section 30*f* is positioned to be slightly lower than a top position of the external thread of the screw core 13. Thus, it is possible to allow the retainer section 30*f* to press the screw core 13 toward a center thereof when the screw core 13 is installed approximately at a center portion of the bobbin 30.

Further, as shown in FIGS. 28 and 29, the screw core 13 has a hexagonal hole 13*a* penetrating in the longitudinal direction of the bobbin 10 to allow the distal end 14*a* of the jig 14 shown in FIG. 30 to be inserted in the screw core 13.

In the compensation coil 7 of the prior art, the bobbin 10 and the screw core 13 are forcibly engaged (interference fit). Thereby, a predetermined rotational torque given to the screw core 13 is obtained by such a preloading arrangement.

On the other hand, in the compensation coil 72 of the present invention, the screw core 13 is loosely fitted in the hollow 30*a* of the bobbin 30 having a slight clearance except for the retainer section 30*f*.

Interposed between the retainer section 30*f* and the bottom of the hollow 30*a*, the screw core 13 is given a certain rotational torque in a radial direction of the screw core 13 caused by a pressing force of the retainer section 30*f*.

Thereby, the displacement of the screw core 13 is prevented even when a vibration is externally applied to the compensation coil 72.

In this embodiment, as the bobbin 30 of the compensation coil 72 is made of the two halves 72A, 72B, it is easy to fabricate the compensation coil 72 by placing the screw core 13 in the one half 72B by bending the retainer section 30*f* outward and then covering the screw core 13 with the other half 72A. Thereby, the screw core 13 can be positioned at the center of the compensation coil 72. This enables the worker to save the troublesome process of inserting the screw core 13 into the bobbin 30, resulting in an improvement of the working efficiency. Needless to say, it is possible to connect the two halves 72A, 72B with a hinge.

Further, the internal thread is preliminarily cut on the inner surface of the hollow 30*a* of the bobbin 30, it is possible to save the inserting process for inserting the screw core 13 into the bobbin 30 up to the other end thereof and returning it to be positioned at a center of the bobbin 30.

Needless to say, it is possible to insert the screw core 13 into the bobbin 30 at the center position thereof from one end of the hollow 30*a* manually with the jig 14 or by the automatic machine 16 as shown in FIG. 30.

The compensation coil 72 obtained as mentioned above is installed on the deflection yoke device shown in FIG. 26, and is connected to the horizontal deflection coils 3*a*, 3*b* as shown in FIG. 7.

Specifically, as shown in FIG. 7, the horizontal deflection coils 3*a*, 3*b* are connected in parallel to each other and between a plus terminal and a minus terminal, and further connected to the coils 11, 12 of the compensation coil 72 in series. Further, upon operation, the currents I*a*, I*b* flow through the horizontal deflection coils 3*a*, 3*b*.

As shown in FIG. 30, when the screw core 13 is displaced in the longitudinal direction as rotated, respective inductances L11, L12 of the coils 11, 12 are differentially changed.

Thereby, the currents I*a* and I*b* flowing through the horizontal deflection coils 3*a*, 3*b* are adjusted, and a magnetic field generated by the horizontal deflection coils 3*a*, 3*b* is controlled, resulting in a compensation of the displacement amount Xv of a red line from a blue line which is one of the misconvergences shown in FIG. 8.

In the compensation coil 72 of the present invention, as the internal thread is preliminarily cut on the inner surface of the hollow 30*a* of the bobbin 30, it is not necessary to cut the internal thread at the process of inserting the screw core 13 into the bobbin 30.

As the screw core 13 is loosely fitted with the internal thread formed in the inner surface of the hollow 30*a* of the bobbin 30, it is not possible that the internal thread is worn by the reciprocating motion of the screw core 13 thus the rotational torque is decreased. Further, there is no problem of chipping or cracking of the screw core 13.

Further, it is possible to optionally give a desired rotational torque to the screw core 13 by determining the position of the inner surface of the retainer section 30*f* in the radial direction of the bobbin 30 or a degree of elasticity of the retainer section 30*f*.

Thereby, as the retainer section 30*f* can press the screw core 13 in the radial direction thereof, a stable and optimum rotational torque for rotating the screw core 13 can be obtained. Upon the rotating the screw core 13, this torque enables a smooth operation capable of a delicate adjustment of the screw core 13, resulting an increase of the working efficiency.

In the compensation coil 72 equipped with the retainer section 30*f*, the retainer section 30*f* prevents the screw core 13 from displacing in the longitudinal direction (the B-B' direction in FIGS. 7 and 30) even when a vibration is applied to the compensation coil at the delivery, resulting in an easy adjustment for the worker.

Accordingly, the adjustment in the ITC maker becomes an easy one. In addition, the deflection characteristics of the deflection yoke device adjusted at the delivery maintains as it is, resulting in a save of working time or an elimination of extra working. Accordingly, the re-adjustment process is eliminated in the display equipment maker.

In this embodiment, as mentioned in the foregoing and will be understood from FIG. 30, the internal thread is not cut on both sides of the half 72A and 72B in the hollow 30*a*, but only on the half 72B side in the hollow 30*a*. The reason is that when the internal thread is cut on the both sides of the half 72A and the half 72B in the hollow 30*a*, the screw threads of them are apt to be shifted in the longitudinal direction from each other at the assembly thereof.

Accordingly, as shown in FIG. 30, the internal thread is cut only, for instance, on the half 72B side having the retainer section 30*f* in the hollow 30*a*. Thereby, the problem of the shifting of threads can be eliminated.

In this embodiment, the internal thread is cut only on the half 72B side in the hollow 30*a*, however, the internal thread may be formed on the half 72A side in the hollow 30*a*. Further, in this embodiment the internal thread is cut at a center portion of the half 72B, because the screw core 13 is displaced only in the vicinity of the center portion in the longitudinal direction (B-B').

However, it is possible to provide the internal thread over the half 72B side in the hollow 30*a*. At least, the internal thread is cut nearby the retainer section 30*f*.

As the retainer section 30*f* forms a part of the hollow 30*a*, it is possible to cut the internal thread in the inner surface of the retainer section 30*f*. In other words, the internal thread can be provided on the inner surface of the hollow 30*a* containing the retainer section 30*a*. Even when the internal thread is cut either on the half 72A side or the half 72B side in the hollow 30*a*, there is no problem for displacing the screw core 13.

As seen from the above, the two halves 70A and 70B of the bobbin 30 enable the bobbin 30 to be readily molded with the resin and an easy installment of the screw core 13 in the bobbin 30 by forming the internal thread on only one side of the halves 72A, 72B.

Next, the description is given of a modification of the compensation coil 72 of the third embodiment referring to FIG. 31, wherein the coils 11, 12 are omitted for simplicity. In the compensation coil 72 shown in FIG. 31, the retainer section 30*f* is not integrally formed with the bobbin 30, but formed separately as a retainer member 30*a*'. The retainer member 30*f*' is provided with a protruding portion 30*f*1'. It is possible to obtain the same effect as that of the third embodiment by connecting the retainer member 30*f*' to the half 72B with well known connecting means.

Incidentally, when the coils 11, 12 are wound around the bobbin 30, the bobbin 30 is slightly deformed, resulting in an decrease of the diameter of the hollow 30*a*.

FIGS. 32 (A) and 32 (B) are sectional view along the A—A line shown in FIG. 27 for explaining the deformation of the bobbin when the coil is wound therearound, wherein the coils 11 and 12 are depicted for convenience.

Generally, when an inner diameter of the hollow 30*a* becomes smaller caused by the deformation of the bobbin 30, the rotational torque for rotating the screw core 13 is changed compared with that of the bobbin 30 having no coils.

However, according the construction of the present invention, a distance from a bottom of the half 72B to the protruding portion 30f1 provided at the distal end of the retainer section 30*f* is scarcely changed even when the bobbin 30 is deformed, because the bobbin 30 has such a construction that the protruding portion 30*f*1 of the retainer section 30*f* does not reside on portions on which the coil 11 and 12 are wound, but protrudes from the half 72B and presses the screw core 13 to the bottom of the half 72B. Thus, the rotational torque for rotating the screw core 13 is never changed, resulting in a consistent rotational torque.

Further, by thinning the thickness of the half 72A or by forming the half 72A with a deformable resin whereas the sturdiness of the half 72 is maintained, it is possible to more effectively eliminate the deformation of the bobbin 30 by causing the half 72A to absorb the affect of the deformation, resulting in a further enhancement of the effectiveness without affecting the rotational torque.

Further, the pressing force applied to the screw core 13 is determined by the distance between the protruding portion 30*f*1 and the bottom of the hollow 30*a* of the half 72B and a degree of elasticity of the retainer section 30*f*. In other words, it is possible to control the rotational torque of the screw core 13 only by the construction of the half 72B, resulting in an easy design for a necessary rotational torque for rotating the screw core 13.

While the presently preferred embodiments of the present invention have been shown and described, it is to be understood that these disclosures are for the purpose of illustration and that various changes and modification may be made without departing from the scope of the invention as set forth in the appended claims.

In the third embodiment, the retainer section 30*a* is made of an arch plate but it is possible to employ an optional shape such as an L-shaped plate. Further, a resilient member such as a coil spring or a plate spring can be used as the retainer section 30*f*.

It is to be understood that all the constructions where the bobbin 30 and the screw core 13 are loosely fitted and the screw core 13 is pressed by a predetermined retainer section, are included in the scope of the present invention.

Further, in the present invention, the compensation coil for compensating the misconvergence is explained, however, the construction thereof can be applied to any compensation coils where the screw core 13 is installed in the cylindrical bobbin and the position of the screw core 13 is adjusted.

As mentioned above, in the deflection yoke device of the present invention comprising an approximately cylindrical bobbin having a coil thereon and a hollow formed with an internal thread on an inner surface thereof and a screw core which is installed in the hollow and is displaced in the longitudinal direction, the bobbin is comprised of first and second halves being separated in half in a longitudinal direction thereof, and on one of the first and second halves there is provided a retainer section extending to another half for pressing the screw core. Thus, the displacement of the screw core due to vibrations caused by transportation is effectively prevented.

Accordingly, it is possible to eliminate a problem such as a change of deflection characteristic of the deflection yoke device caused by the vibration at the transportation of the deflection yoke and the products in the ITC state. Thus, the extra adjustment work can be saved in the ITC makers and the display equipment makers. Further, it enables the positional adjustment of the screw core unlike the adhesive being applied.

Further, upon adjusting the position of the screw core by rotating, the rotational torque becomes consistent, which enables a smooth and delicate adjustment operation. The rotational torque for rotating the screw core is not changed even when the coils are wound around the bobbin. As the screw core has a construction that the rotational torque is given by pressing the screw core with the retainer section, the screw core does not need to be forcibly engaged with the bobbin, which eliminates the problem of chipping and cracking of the screw core. Further, even when the screw core is repeatedly rotated, the rotational torque is not decreased due to wear.

What is claimed is:

1. A deflection yoke device used for a cathode ray tube comprising:

a compensation coil having a bobbin formed with a hollow in which an internal thread is cut;

a screw core forcibly fitting in the hollow of the bobbin to allow the screw core to be displaced in a longitudinal direction of the bobbin; and a damping material composed of a silicone composition having a viscosity of 0.5 to $10\times10^5$ cSt interposed between the bobbin and the screw core for dampening vibrations and preventing a displacement of the screw core when an external disturbance is applied to the deflection yoke device.

2. A deflection yoke device as claimed in claim 1, wherein the damping material is composed of a liquid silicone.

3. A deflection yoke device used for a cathode ray tube comprising:

a compensation coil having a bobbin formed with a hollow in which an internal thread is cut;

a screw core fitting in the hollow of the bobbin to allow the screw core to be displaced in a longitudinal direction of the bobbin; and a silicone gel material having a viscosity of 0.5 to $10\times10^5$ cSt interposed between the bobbin and the screw core for dampening vibrations and preventing a displacement of the screw core when an external disturbance is applied to the deflection yoke device.

4. A method of manufacturing a compensation coil used for a deflection yoke device of a cathode ray tube, with said compensation coil having a hollow bobbin and with said deflection yoke having a screw core comprising the steps of:

applying a damping material to the surface of said screw core, in which said damping material is composed of a liquid or gel silicone composition, having a viscosity of 0.5 to $10\times10^5$ cSt;

cutting an internal thread in the hollow of the bobbin by inserting the screw core into the hollow of said bobbin so as to cause the damping material to substantially cover the hollow interior surfaces of the bobbin.

5. A method of manufacturing a compensation coil used for a deflection yoke device of a cathode ray tube, with said compensation coil having a hollow bobbin and with said deflection yoke having a screw core comprising the steps of:

cutting an internal thread in the hollow of the bobbin;

applying a damping material to the interior surfaces of the hollow bobbin with said damping material composed of a liquid or gel silicone composition, having a viscosity of 0.5 to $10\times10^5$ cSt; and screwing and inserting the screw core into the hollow of the bobbin.

* * * * *